US011786958B2

(12) United States Patent
Woo

(10) Patent No.: US 11,786,958 B2
(45) Date of Patent: Oct. 17, 2023

(54) HIGH-SPEED AND HIGH QUALITY NAIL-MAKING SYSTEM

(71) Applicant: Gyeondong Woo, Daegu (KR)

(72) Inventor: Gyeondong Woo, Daegu (KR)

(73) Assignee: ZEUS TECHNO INC., Daegu (KR)

( * ) Notice: Subject to any disclaimer, the term of this patent is extended or adjusted under 35 U.S.C. 154(b) by 285 days.

(21) Appl. No.: 17/381,600

(22) Filed: Jul. 21, 2021

(65) Prior Publication Data

US 2022/0274156 A1 Sep. 1, 2022

(30) Foreign Application Priority Data

Feb. 26, 2021 (KR) ..... 10-2021-0026061

(51) Int. Cl.
*B21G 3/12* (2006.01)

(52) U.S. Cl.
CPC ..... *B21G 3/12* (2013.01)

(58) Field of Classification Search
CPC ... B21G 3/00; B21G 3/12; B21G 3/16; B21G 3/20; B21G 3/26; B21G 3/28; B21K 1/44; B21K 1/48; B21K 1/466
See application file for complete search history.

(56) References Cited

U.S. PATENT DOCUMENTS 4,184,217 A * 1/1980 Dohi ..... B21K 1/56 470/65
4,493,202 A * 1/1985 Stafford ..... B21J 13/14 470/134
5,081,732 A * 1/1992 Steinhilber ..... B21K 1/46 470/40
5,140,715 A * 8/1992 Monacelli ..... B21G 3/20 470/128
5,250,008 A * 10/1993 Lange ..... B21G 3/12 72/422
8,998,733 B2 * 4/2015 Kim ..... B21G 3/20 470/110
2002/0052244 A1 * 5/2002 Halstead ..... B21G 3/30 470/129

(Continued)

FOREIGN PATENT DOCUMENTS

JP 2002137117 A * 5/2002 ..... B21G 3/12

OTHER PUBLICATIONS

Translation of JP-2002137117-A (Year: 2002).*

*Primary Examiner* — Bobby Yeonjin Kim
(74) *Attorney, Agent, or Firm* — John K. Park; PARK LAW FIRM

(57) ABSTRACT

A high-speed and high-quality nail-making system is disclosed. The system includes an inner wheel, which is rotated by a motor and a power transmission unit and which clamps and transfers steel wire pieces, an outer wheel, which is passively rotated and which is eccentrically disposed outside the inner wheel so as to press the steel wire pieces at a punching portion, at which the outer wheel is positioned closest to the inner wheel, inner and outer wheel dies, which are mounted on the inner wheel and the outer wheel and which are positioned closest to each other at the punching portion so as to grip the steel wire pieces, a punching unit, which is rotated together with the inner wheel and which punches front ends of the steel wire pieces to form nail heads, and an ejector disposed between the inner wheel and the outer wheel so as to discharge the finished nail.

19 Claims, 47 Drawing Sheets

(56) References Cited

U.S. PATENT DOCUMENTS

| | | | | |
|---|---|---|---|---|
| 2010/0183403 | A1* | 7/2010 | Ali | B21G 3/12 470/34 |
| 2012/0270667 | A1* | 10/2012 | Kim | B21G 3/12 470/121 |

* cited by examiner

HIGH-SPEED AND HIGH QUALITY NAIL-MAKING SYSTEM

BACKGROUND OF THE INVENTION

Field of the Invention

The present invention relates to a high-speed and high-quality nail-making system which combines the benefit of a typical linear crank-type low-speed nail-making machine, which is capable of making high-quality nails, with the benefit of a rotating drum-type nail-making machine, which is capable of producing nails at high speed but has a limitation with regard to quality, thereby solving the problems of low productivity and limited quality.

Description of the Related Art

Conventional nail-making machines, which are commercially available, are mainly classified into a linear crank-type nail-making machine and a rotating drum-type nail-making machine.

The linear crank-type nail-making machine is constructed to produce nails in such a manner as to repeat a process of uniformly straightening a steel wire, forming a nail head at the front end of the steel wire, transferring the steel wire by a predetermined distance, cutting the steel wire, and discharging the steel wire. Although the linear crank-type nail-making machine, which uses a serial process, has a disadvantage in which it is impossible to exceed a limited production speed, there is an advantage in that it is possible to accurately form nail heads having various shapes.

Meanwhile, the rotating drum-type nail-making machine, which includes a drum rotating at high speed and unit components disposed around the drum, is constructed to produce nails in such a manner as to cut a steel wire to a predetermined length, transfer the cut steel wire piece, press the front end of the transferred steel wire piece to thus form a nail head, and discharge the steel wire piece having the formed nail head. Although the rotating drum-type nail-making machine is capable of producing nails at high speed, it is limitedly able to accurately form nails having various shapes.

In other words, the linear crank-type nail-making machine has a limitation on production speed, and the rotating drum-type nail-making machine has a limitation with regard to formation of nails having various nail heads.

RELATED ART DOCUMENTS

Patent Document 1

Korea Patent Registration Publication No. 10-0281572 (entitled "machine for making head of screw nail" and published on Feb. 15, 2001)

Patent Document 2

Korea Patent Registration Publication No. 10-1103079 (entitled "punching device of nail-making machine" and published on Jan. 6, 2012)

SUMMARY OF THE INVENTION

Therefore, the present invention has been made in view of the above problems, and it is an object of the present invention to provide a high-speed and high-quality nail-making system which combines an effect of a typical linear crank-type low-speed nail-making machine, which is capable of making high-quality nails, with an effect of a rotating drum-type nail-making machine, which is capable of producing nails at high speed but has a limitation with regard to quality, thereby overcoming low productivity and a quality limitation.

It is another object of the present invention to provide a high-speed and high-quality nail-making system, which has greatly improved productivity and excellent merchantability by being configured such that the transfer of steel wire pieces, which will be produced into nails, is performed by an inner wheel and formation of nail heads is performed by a plurality of punches, which are rotated together with the inner wheel and are linearly reciprocated.

It is still another object of the present invention to provide a high-speed and high-quality nail-making system in which an inner wheel, which has a smaller size and is rotated in one direction at high speed, is eccentrically disposed in an outer wheel, which has a larger size and is passibly rotated, so as to be closest thereto at a punching portion or a shaping portion, at which nail heads are shaped, and to allow finished nails to be rapidly discharged to a discharge space, which is naturally defined between the inner wheel and the outer wheel due to the difference between the diameters of the inner and outer wheels.

It is yet another object of the present invention to provide a high-speed and high-quality nail-making system, which is capable of rapidly forming high-quality nail heads in such a manner as to clamp a steel wire piece, which is prepared by cutting a steel wire, using a clamp of an inner wheel, which is rotated at high speed, transfer the steel wire piece to a punching portion and a discharge portion, and punch the steel wire piece transferred to the punching portion using a corresponding one of a plurality of punches, which are rotated together with the inner wheel and are linearly reciprocated by a cam device, and a punch push roller configured to press and move the corresponding punch forwards, in the state of securely gripping the steel wire piece using inner and outer wheel dies.

In accordance with the present invention, the above and other objects can be accomplished by the provision of a high-speed and high-quality nail-making system including an inner wheel, which is rotated in one direction by means of a motor and a power transmission unit and which clamps and transfers steel wire pieces, which are sequentially introduced thereinto, an outer wheel having an inside diameter greater than the outside diameter of the inner wheel, which is passively rotated and which is eccentrically disposed so as to press the steel wire pieces at a punching portion, at which the outer wheel is positioned closest to the inner wheel, inner and outer wheel dies, which are mounted on the outer circumferential surface of the inner wheel and the inner circumferential surface of the outer wheel and which are positioned closest to each other at the punching portion so as to grip the steel wire pieces, a punching unit, which is rotated together with the inner wheel and which is configured such that punches thereof are linearly reciprocated by means of a cylindrical cam so as to punch front ends of the steel wire pieces gripped between the inner and outer wheel dies to thus form nail heads, and an ejector, which is disposed in a discharge space defined between the inner wheel and the outer wheel and which releases a clamp to thereby unclamp and discharge the finished nail.

The inner wheel may include a shaft pipe fixed to the front surface of a base wall, an inner wheel disc rotatably mounted on the outer surface of the shaft pipe via a ring bearing, a ring gear fixed to a rear surface of the inner wheel disc, a plurality of inner wheel dies and a plurality of clamps, which are alternately mounted on the outer circumferential surface of the inner wheel disc at regular intervals, and a fixing ring and a fastener, configured to fix the ring bearing.

The outer wheel may include a ring base mounted on the front surface of the base wall, a ring bearing mounted at a stepped portion of the ring base by means of a fastening element and fixing rings, an outer wheel disc mounted on the front surface of the ring bearing so as to be freely rotatable by means of a fastening element, a plurality of outer wheel dies fixed to the inner circumferential surface of the outer wheel disc at regular intervals, and a fixing member configured to fix the outer wheel dies.

The high-speed and high-quality nail-making system may further include a stopper configured to prevent excessive forward movement of the steel wire pieces, which are sequentially introduced.

The distance between one of the plurality of inner wheel dies and a corresponding one of the plurality of outer wheel dies may range from 0.5 mm to 5 mm.

The number of inner wheel dies may be the same as the number of clamps, and the number of outer wheel dies may be greater than the number of inner wheel dies by one to five.

A steel wire, which will be cut into the steel wire pieces, may be formed into a linear state by means of horizontal correction rollers and vertical correction rollers, may be controlled in transfer speed by means of upper and lower transfer rollers, rotational speeds of which are controlled by means of a change gear, and may be cut into steel wire pieces each having a predetermined length by means of upper and lower cutting rollers, the steel wire pieces being sequentially introduced into a steel wire introduction portion by means of a high-speed feeding portion and being clamped by the clamps, which are fixed to the outer circumferential surface of the inner wheel at regular intervals.

The rotational speed of the upper and lower transfer rollers may be controlled by varying the gear ratio of the change gear so as to set the cutting length of the steel wire and thus the length of a nail.

The punching unit may include a cylindrical punching drum, a plurality of guide holes formed in a peripheral portion of the punching drum at regular intervals, punches fitted into the guide holes so as to be capable of reciprocating, a ring bearing coupled into a cavity in the punching drum, front and rear fixing plates coupled to an inner circumferential surface of the ring bearing, a support ring fixed to a rear surface of the punching drum, a plurality of projecting rods, which are fixed to a rear surface of the support ring and which project rearwards and are coupled into coupling grooves formed in a front surface of the inner wheel so as to transmit the rotative force of the inner wheel to the punching drum, and a cylindrical cam fixed to the front fixing plate, the punches being coupled into a cam groove in the cylindrical cam.

The punch may include a body, a rod body coupled to a lower portion of the body, a slit formed in the body in the longitudinal direction of the body, a punching surface formed at an end of the rod body, a bolt and a nut, which are fitted into a fastening hole formed in the body with a slit formed in a center of the body and which presses an upper portion of the rod body coupled into a coupling groove formed in the body to fix the body to the rod body, a cam follower bearing, which is coupled to an outer surface of a stepped portion of the bolt so as to be freely rotatable and which is coupled into the cam groove in the cylindrical cam, and a projecting portion and a recess portion respectively formed at front and rear portions of the body.

Each of the clamps may include a cylindrical pipe having therein a coupling hole, which is longitudinally formed and is open upwards, an actuating lever, which projects from an upper surface of the cylindrical pipe in one direction and has a flat surface, an elastic body, which is surrounded by a torsion spring and has an elastic support portion, which is formed at an upper portion thereof and has a flat surface formed at one side thereof, a fixing groove formed in the coupling hole in which a lower end protrusion of the torsion spring is fitted, and an upper end protrusion of the torsion spring projecting upwards from the cylindrical pipe.

The flat surface of the elastic body, which is elastically supported by the torsion spring, is maintained at an angle of about 45 degrees ($\theta 1$) relative to the direction in which the steel wire piece is introduced.

The flat surface of the actuating lever may be maintained at an angle of 40 to 100 degrees ($\theta 2$) relative to the direction in which the steel wire piece is introduced.

The steel wire piece may be clamped between a lateral side surface of a support plate fixed to the inner wheel and an elastic portion of each of the clamps, which is biased in a clockwise direction.

The high-speed and high-quality nail-making system may further include an outer wheel adjustment unit configured to finely move the outer wheel to thus cause a gripping groove in the inner wheel die to face and to be aligned with a gripping groove in the outer wheel die, and the outer wheel adjustment unit may include a shaft pin, configured to rotatably support an upper portion of the outer wheel, and an outer wheel adjuster, configured to support and finely move a lower portion of the outer wheel.

The outer wheel adjuster may include a shaft portion, which has a predetermined outside diameter and is fitted into a through hole in a base wall and a cavity in an eccentric pipe, a flange portion formed at a rear portion of the shaft portion, a plurality of bolts configured to fasten and fix the flange portion to the base wall, a long hole, which is formed in the lower portion of the outer wheel and in which an outer circumferential surface of the eccentric pipe is fitted, a hexagonal protrusion, which is formed at a front end of the eccentric pipe and has an outside diameter greater than an inside diameter of the long hole, a plurality of threaded holes formed in a front surface of the shaft portion, a plurality of bolts engaged with the plurality of threaded holes, and a washer, into which the bolts are inserted and which has an outside diameter greater than an inside diameter of the cavity.

The cylindrical cam may be configured to have the form of a ring having predetermined thickness and width, wherein a cam groove, in which cam follower bearings of the punches are coupled, is formed along an outer circumferential surface of the cylindrical cam, and an advance cam groove is formed in a portion of the cam groove, at which the punching portion is positioned, so as to move the cam follower bearing toward the punching portion.

The high-speed and high-quality nail-making system may further include an adjustment cam, which is mounted on the cylindrical cam so as to adjust the length of a portion of the clamped steel wire piece that is introduced, the adjustment cam including a block coupled into a coupling groove formed in the cylindrical cam, a subsidiary cam groove formed in a portion of the block, an adjustment bolt configured to finely adjust the block to thus move the block close to or away from the punching portion, a threaded hole with which the adjustment bolt is threadedly engaged, and a bolt configured to fasten and fix the finely adjusted block into a threaded hole in the subsidiary cam groove.

The punching unit may include an opening unit capable of pulling the punching unit to open the inner wheel, and the opening unit may include upper and lower guide pipes fixed to the base wall, upper and lower rods, which are coupled to the upper and lower guide pipes and each of which has a long length, a fixing block fixed to front ends of the upper and lower rods, an arm rotatably coupled to the fixing block via a shaft pin, and a plurality of fastening rods, which are fixed to an end of the arm and are fastened and fixed to a front fixing plate of the punching unit.

The high-speed and high-quality nail-making system may further include a punch push roller, which is provided at a portion of the punching unit so as to press a punch, which is transferred to the punching portion by rotation of the punching drum, to thus adjust punching pressure; and a fine adjustment unit, configured to move a rotational center of the punch push roller to thus adjust the pressing force of the punch.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
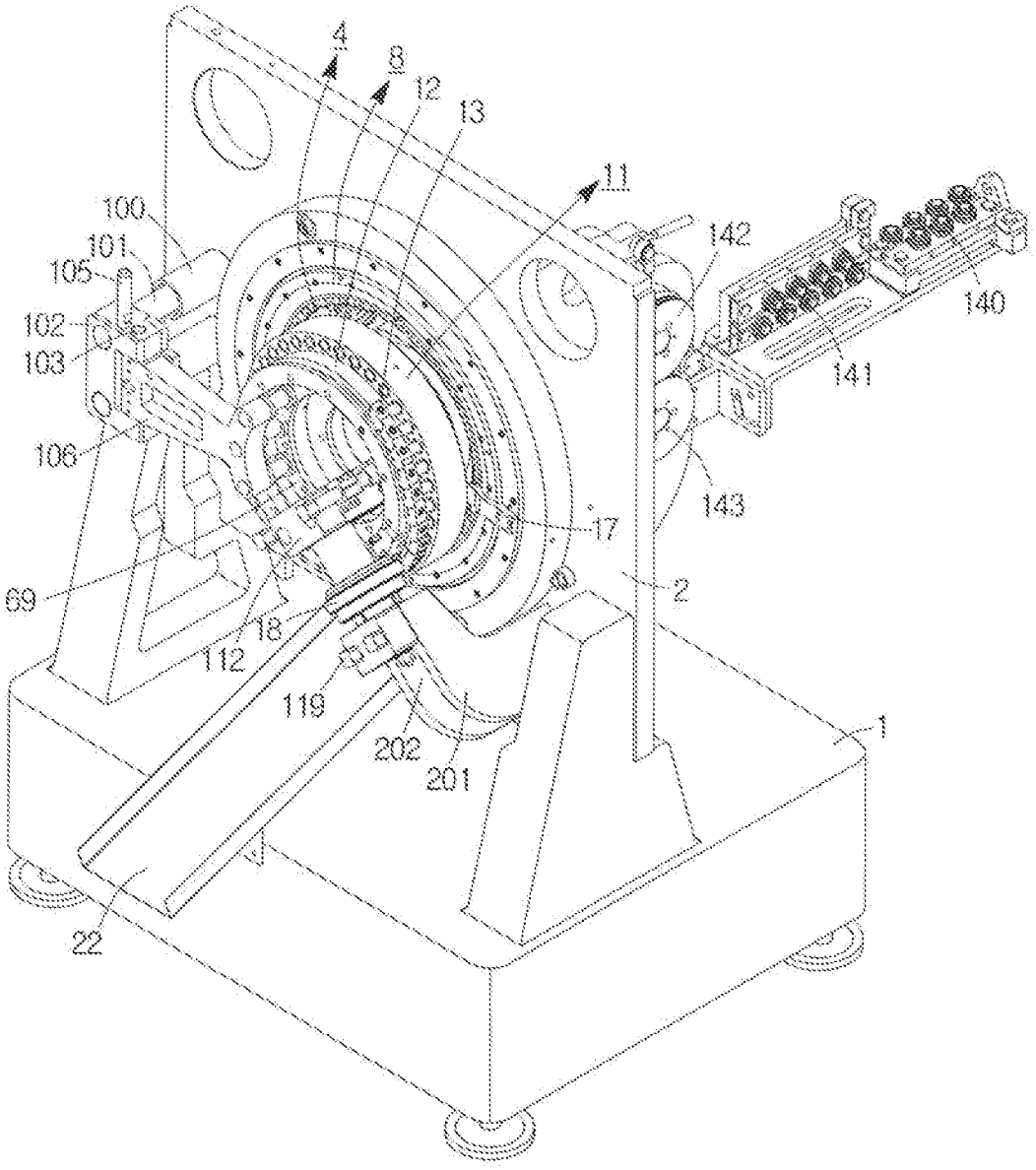
FIG. 1 is a front perspective view illustrating a nail-making system according to an embodiment of the present invention.

Hereinafter, preferred embodiments of the present invention will be described with reference to the accompanying drawings. In the description of the present invention, like reference numerals are used to identify like elements throughout the different drawings. Further, in the following description, if it is decided that a detailed description of known functions or configurations related to the invention would make the subject matter of the invention unclear, the detailed description is omitted.

The present invention provides a high-speed and high-quality nail-making system, which adopts not only a drum type, in which a pair of drums, which are rotatable at high speed and have different sizes, are eccentrically disposed so as to be closest to each other at a punching portion, but also an individual linear punching type, in which a plurality of punches are moved so as to correspond to steel wire pieces, which are being transferred, and one of the punches that is transferred to the punching portion is linearly moved forwards so as to rapidly form a nail head at the front head of a corresponding steel wire piece, and which includes a discharge unit configured to rapidly discharge the steel wire piece having the formed nail head to the discharge space defined between the pair of drums having different sizes, thereby making it possible to produce nails having high quality at high speed.

The high-speed and high-quality nail-making system according to an embodiment of the present invention includes a ring- or drum-shaped inner wheel, which is rotated in one direction by means of a motor, which is a drive unit, and a power transmission unit and which clamps a steel wire piece, which is prepared by cutting a steel wire to a predetermined length, and transfers the steel wire piece to a punching portion, a ring or drum-shaped outer wheel, which is disposed outside the inner wheel and is rotatably mounted so as to be freely rotatable about an axis, inner wheel dies mounted on the outer circumferential surface of the inner wheel at regular intervals, outer wheel dies mounted on the inner circumferential surface of the outer wheel at the same intervals as the inner wheel dies, the number of outer wheel dies being greater than the number of inner wheel dies by one to five such that the inner and outer wheel dies grip a steel wire piece at a punching portion (a nail-head-shaping portion) at which the inner and outer wheel dies are positioned so as to be closest to each other, a punching unit configured to press and punch the gripped steel wire piece so as to form a high-quality nail head using a corresponding one of linearly reciprocating punches and a punch push roller, and an ejector, which is provided in a discharge space between the inner wheel and the outer wheel so as to rapidly discharge the nail that has been provided with the formed nail head by the punching unit to a discharge portion using an ejector, thereby mass-producing high-quality nails having nail heads.

Figure 5:
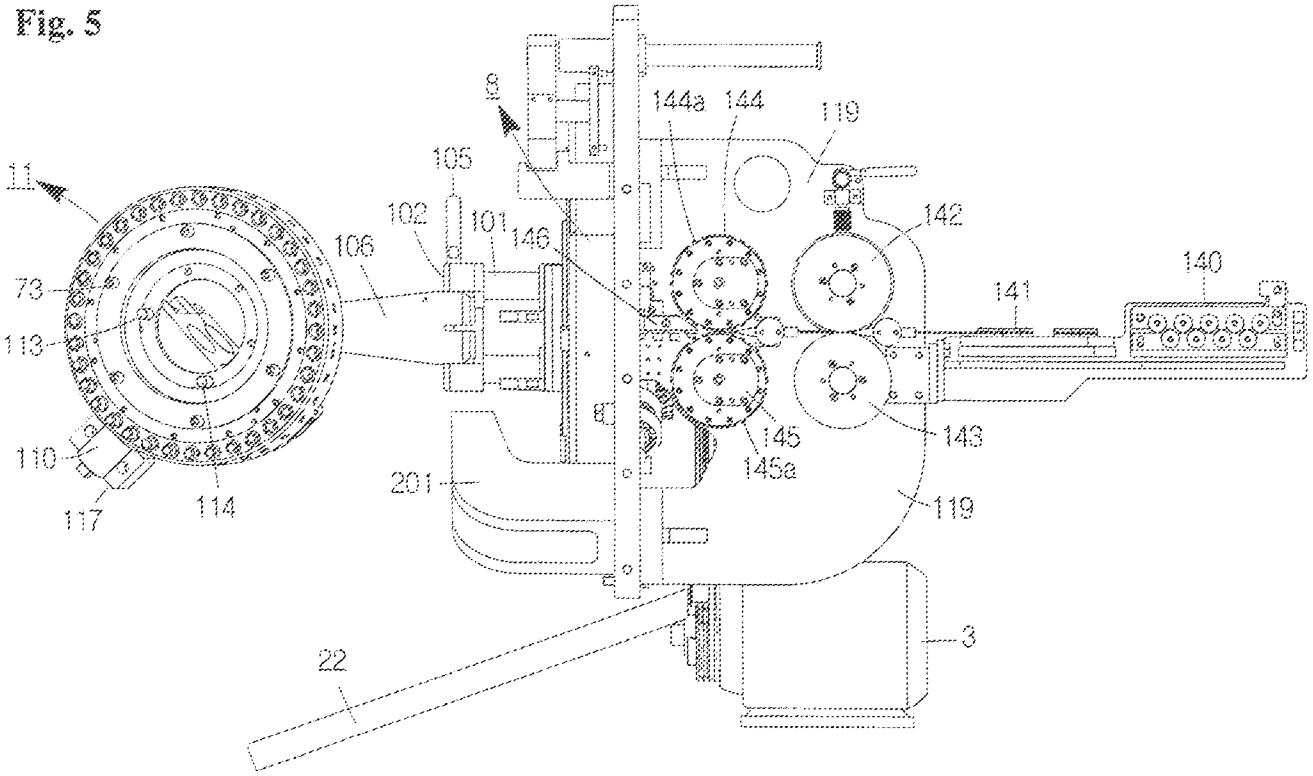
FIG. 5 is a side view illustrating the nail-making system according to the embodiment of the present invention in the state in which a punching unit is open.
Figure 6:
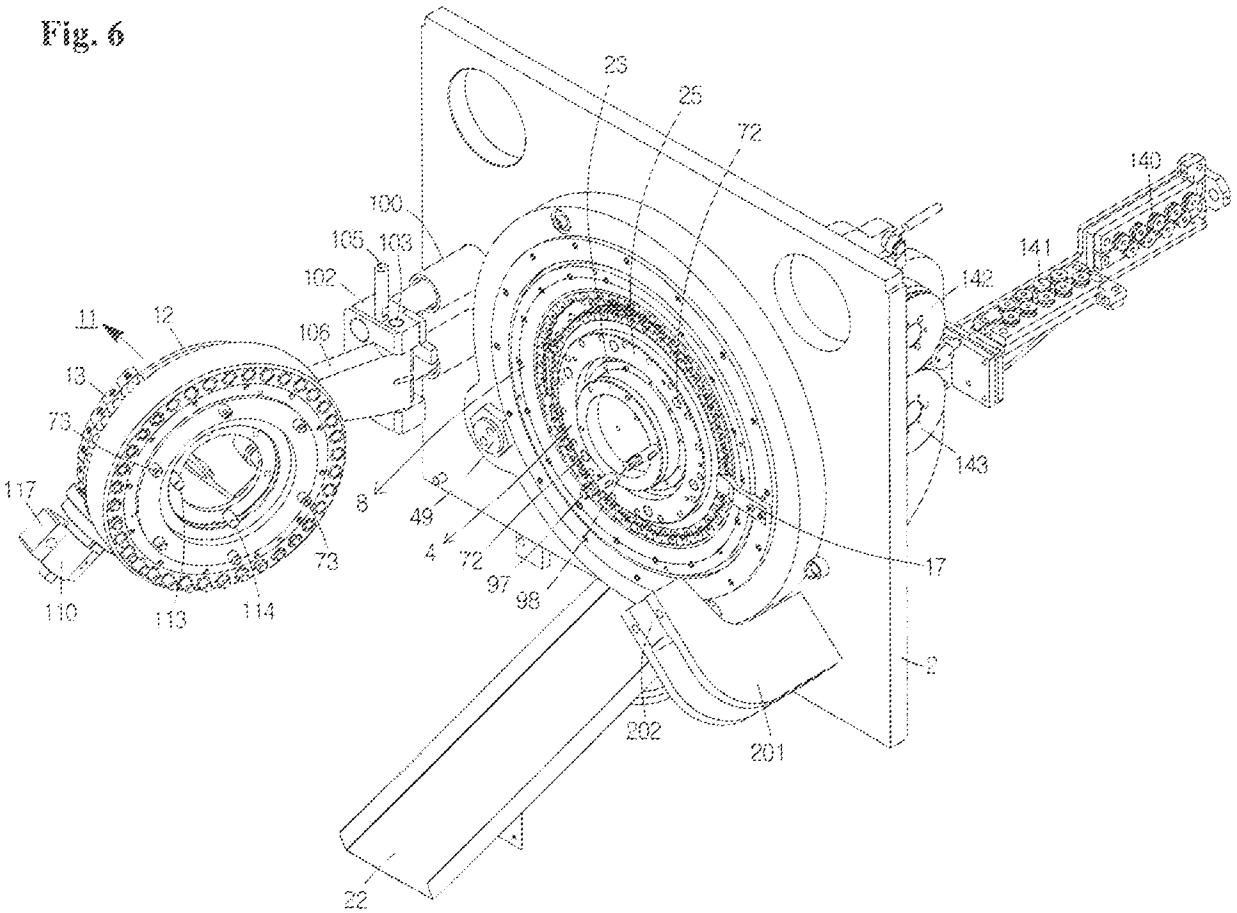
FIG. 6 is a perspective view illustrating the nail-making system according to the embodiment of the present invention in the state in which the punching unit is open.

FIGS. 1 to 4 are perspective views and a front view of a high-speed and high-quality nail-making system according to an embodiment of the present invention. FIGS. 5 and 6 are a front view and a perspective view illustrating the state in which a punching unit 11 is opened using an opening unit. The high-speed and high-quality nail-making system includes an inner wheel 4 having a predetermined outside diameter, which is mounted on the front surface of a base wall 2, which is vertically mounted on a support base 1, so as to be rotatable at high speed in one direction by means of a motor 3 and a power transmission unit, a plurality of inner wheel dies 5 mounted on the outer circumferential surface of the inner wheel 4 at regular intervals, a plurality of clamps 7 mounted on the outer circumferential surface of the inner wheel 4 at the same intervals as the intervals of the inner wheel dies 5 so as to clamp steel wire pieces, which are obtained by cutting a steel wire to a predetermined length and are sequentially introduced, an outer wheel 8, which is mounted on the front surface of the base wall 2 outside the inner wheel 4 so as to be freely rotatable such that the outer wheel 8 is eccentrically positioned in the inner wheel 4 so as to be closest to each other at a shaping portion or a punching portion 15 and which has an inside diameter greater than the outside diameter of the inner wheel 4 and punches front ends of the introduced steel wire pieces 6 to form nail heads 6*a*, a plurality of outer wheel dies 9, which are mounted on the inner circumferential surface of the outer wheel 8 at the same intervals as the intervals of the inner wheel dies 5, and the number of which is greater than the number of inner wheel dies 5 by one to five, a steel wire introduction portion 10, at which steel wire pieces 6, which are obtained by cutting a steel wire to a predetermined length and are sequentially introduced, are introduced (supplied) to the clamps 7 and the inner wheel dies 5, a punching unit 11, which is mounted on the front surface of the inner wheel 4 so as to be rotatable along the inner wheel 4 and which forms nail heads 6*a* at the front ends of the steel wire pieces 6 using a plurality of punches 13, which are linearly reciprocated by means of a cylindrical cam 12, a discharge space 21 and a discharge portion 16, which are configured to discharge the nails N, which have the formed nail heads 6*a*, to the outside of the inner wheel 4 and the outer wheel 8, and an ejector 14 provided in the discharge space 21 and the discharge portion 16.

Figure 7:
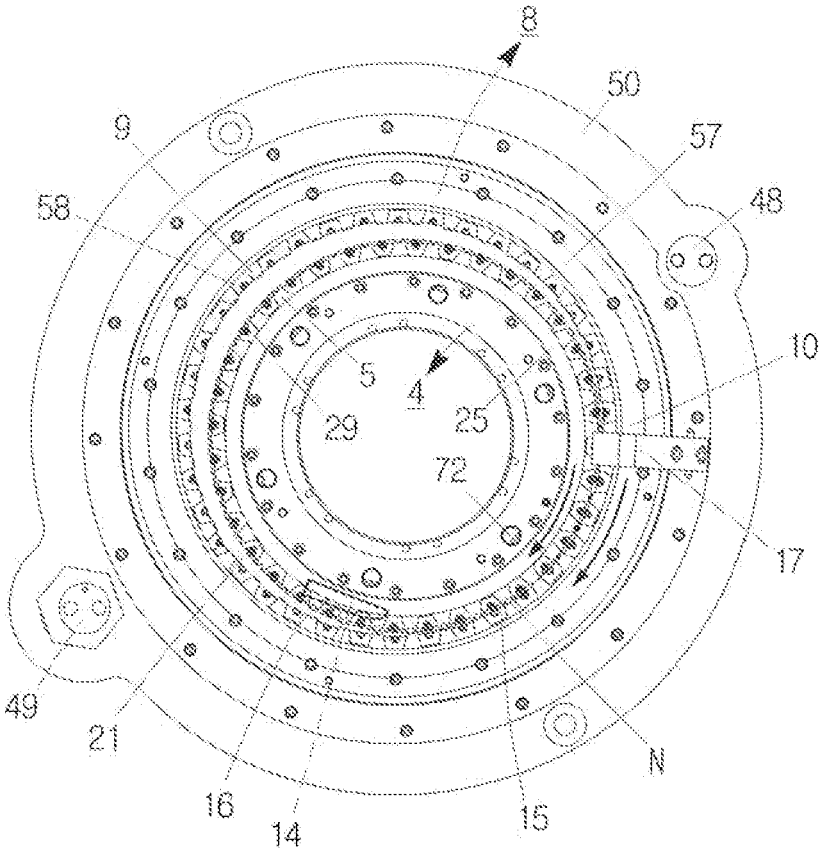
FIG. 7 is a fragmentary front view illustrating an inner wheel and an outer wheel of the nail-making system according to the embodiment of the present invention.
Figure 8:
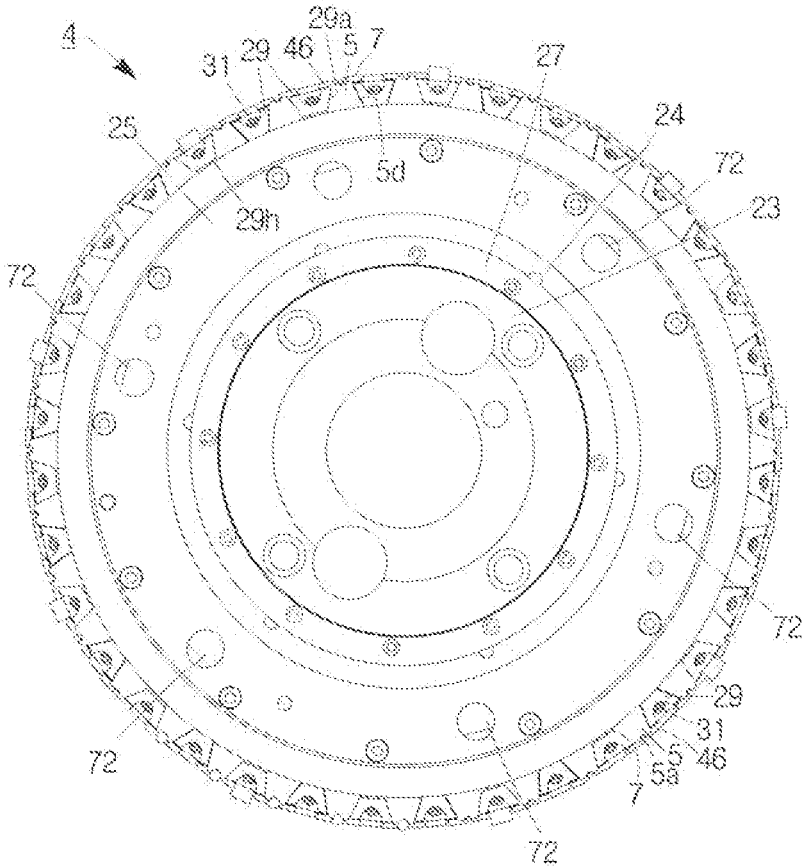
FIG. 8 is a front view illustrating the inner wheel of the nail-making system according to the embodiment of the present invention.
Figure 9:
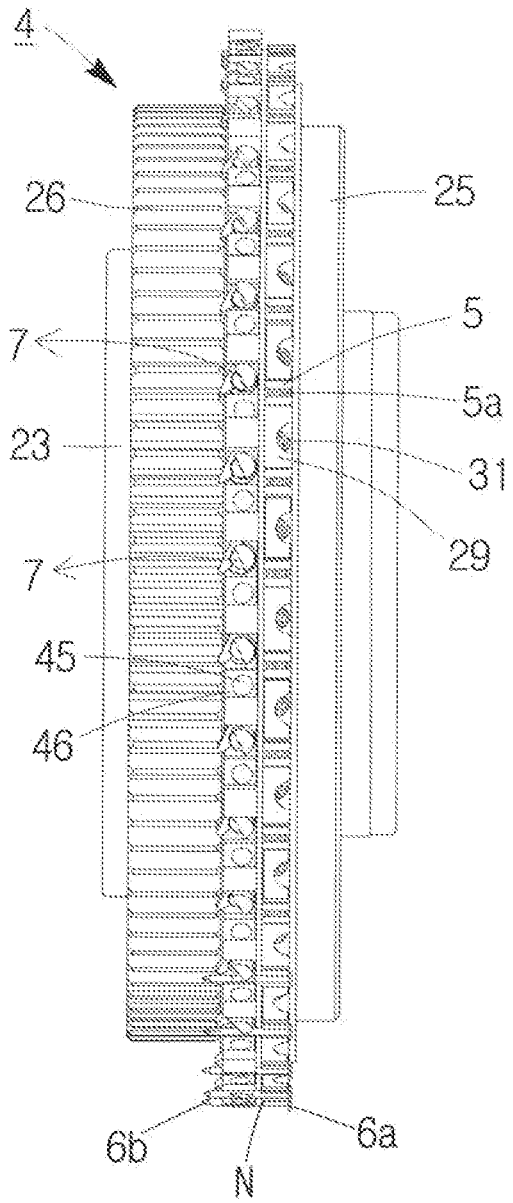
FIG. 9 is a side view illustrating the inner wheel of the nail-making system according to the embodiment of the present invention.
Figure 10:
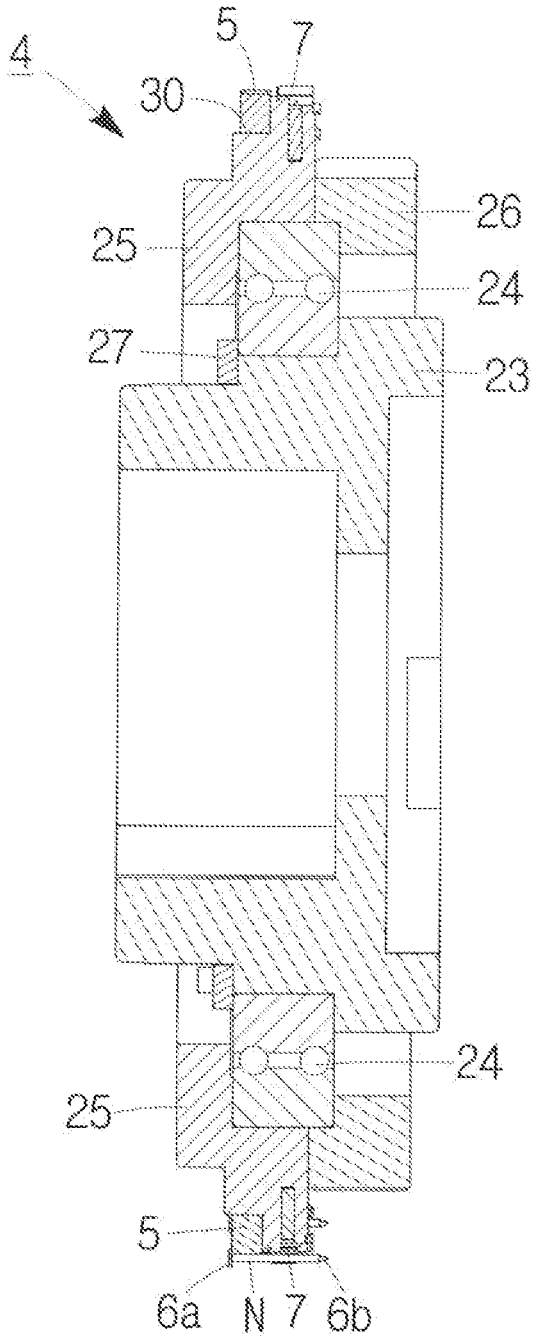
FIG. 10 is a cross-sectional view illustrating the inner wheel of the nail-making system according to the embodiment of the present invention.
Figure 11:
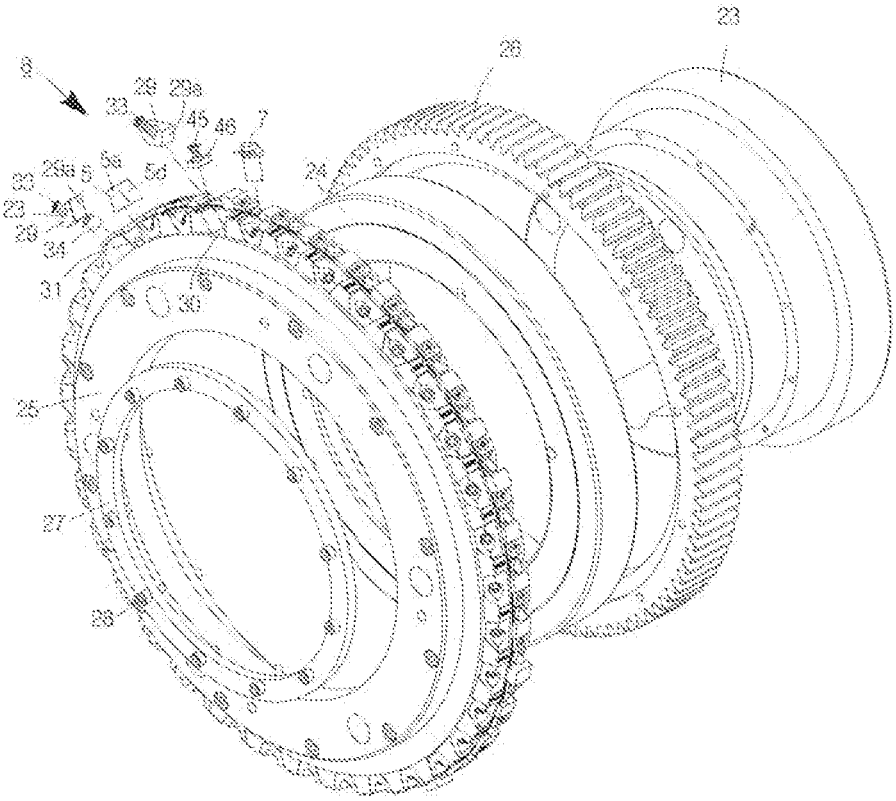
FIG. 11 is an exploded perspective view illustrating the inner wheel of the nail-making system according to the embodiment of the present invention.
Figure 12:
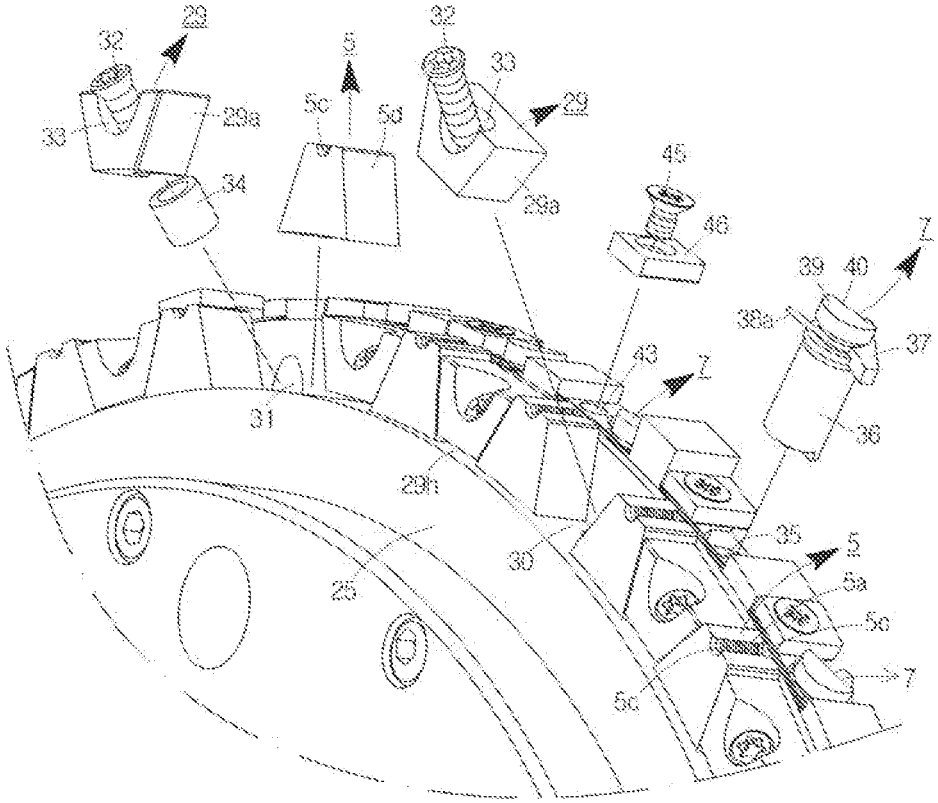
FIG. 12 is an enlarged perspective view illustrating a portion of the inner wheel of the nail-making system according to the embodiment of the present invention.
Figure 13:
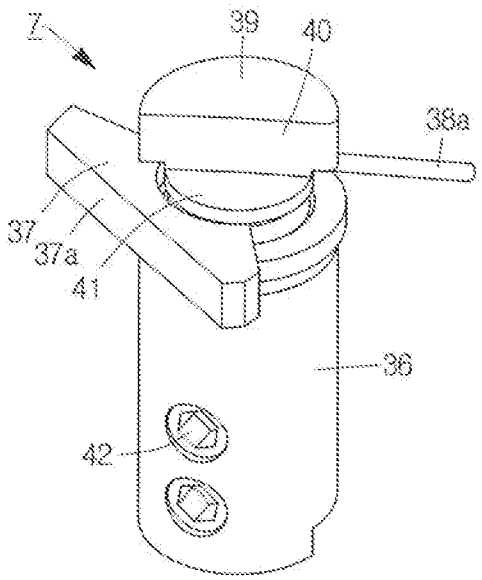
FIG. 13 is a perspective view illustrating a clamp of the nail-making system according to the embodiment of the present invention.
Figure 14:
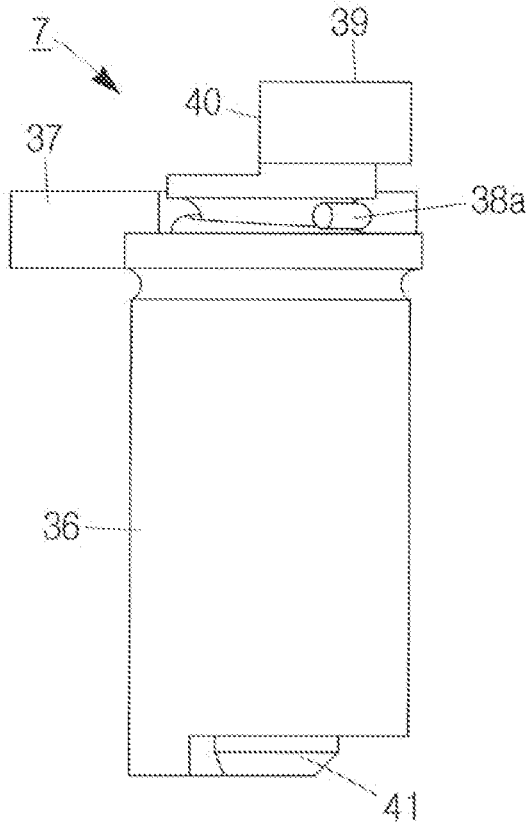
FIG. 14 is a front view illustrating the clamp of the nail-making system according to the embodiment of the present invention.
Figure 15:
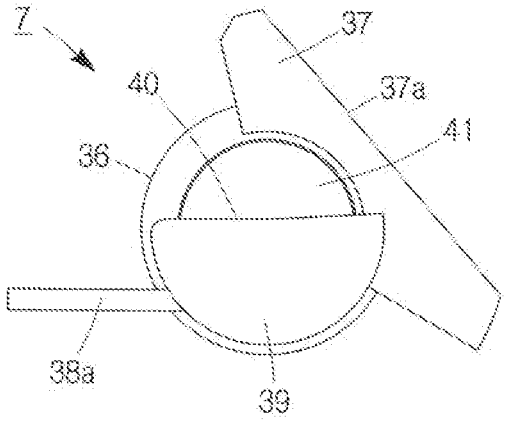
FIG. 15 is a plan view illustrating the clamp of the nail-making system according to the embodiment of the present invention.
Figure 16:
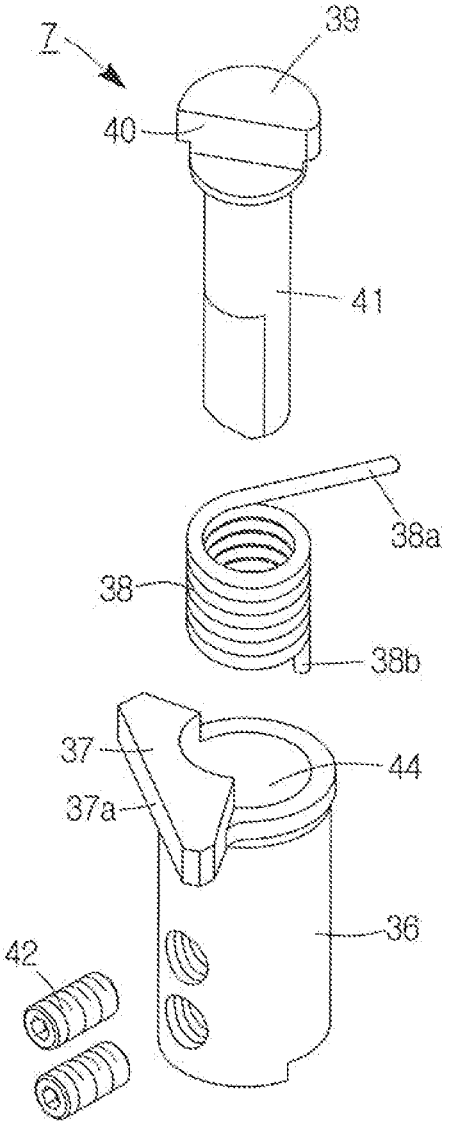
FIG. 16 is an exploded perspective view illustrating the clamp of the nail-making system according to the embodiment of the present invention.
Figure 17:
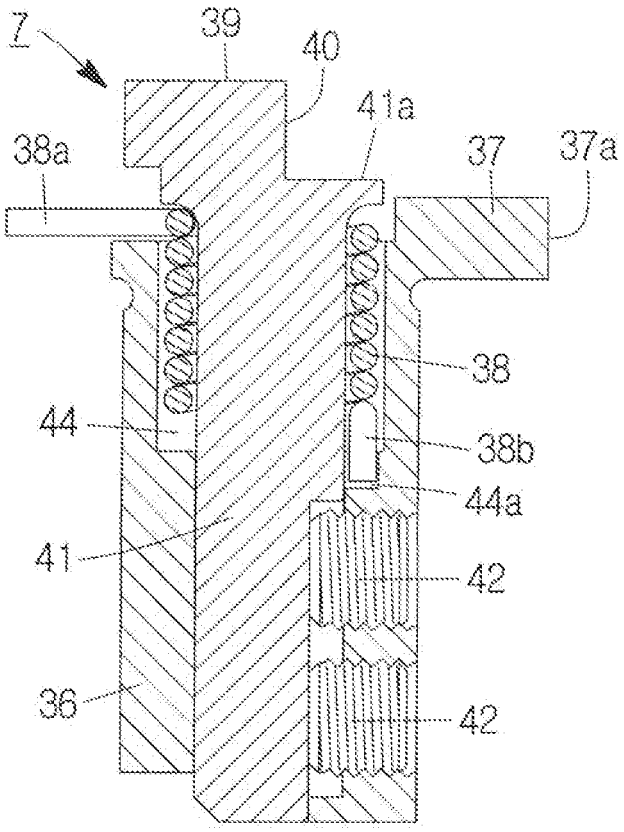
FIG. 17 is a cross-sectional view illustrating the clamp of the nail-making system according to the embodiment of the present invention.

As illustrated in FIG. 7, the inner wheel 4 has an outside diameter different from the inside diameter of the outer wheel 8 such that the inner wheel 4 is eccentrically positioned with the outer wheel 8 so as to be closest to the outer wheel 8 at the punching portion 15. Consequently, a nail discharge space 21 is naturally defined between the inner wheel 4 and the outer wheel 8. The wire introduction portion 10, into which steel wire pieces 6 each having a predetermined length are introduced, is provided in front of the punching portion 15 and in front of the discharge portion 16, which unclamps and discharges nails N each having a nail head 6*a* having a predetermined shape to the outside of the inner wheel 4 and the outer wheel 8 from the punching portion 15.

The high-speed and high-quality nail-making system according to the embodiment of the present invention further includes a stopper 17, which is provided on the front surface of the wire introduction portion 10 so as to stop the steel wire pieces 6, which are sequentially introduced to the stopper 17. The stopper 17 may be fixed to a fixing ring 53 constituting the outer wheel 8. It is possible to control (decide) the size (the outside diameter) and the thickness of the nail head 6*a* by adjusting the distance between the stopper 17 and the steel wire introduction portion 10.

The steel wire piece 6, which is introduced into the steel wire introduction portion 10, is stopped by means of the stopper 17 mounted on the front surface of the steel wire introduction portion 10, is clamped by a corresponding one of the plurality of clamps 7 mounted to the inner wheel 4, is transferred to the punching portion 15, is forcibly gripped between the inner wheel die 5 and the outer wheel die 9, and is formed so as to have the nail head 6*a* by means of the punch 13, thereby producing a high-quality nail N. The nail N, which has the nail head 6*a* formed thereon, is moved along the inner wheel 4 in the state of being clamped, is unclamped by means of the ejector 14 so as to be completely separated from the inner wheel die 5, and is discharged to the outside of the inner wheel 4 and the outer wheel 8 while falling along a sloped chute 22 through the discharge space 21 between the inner wheel 4 and the outer wheel 8.

Figure 2:
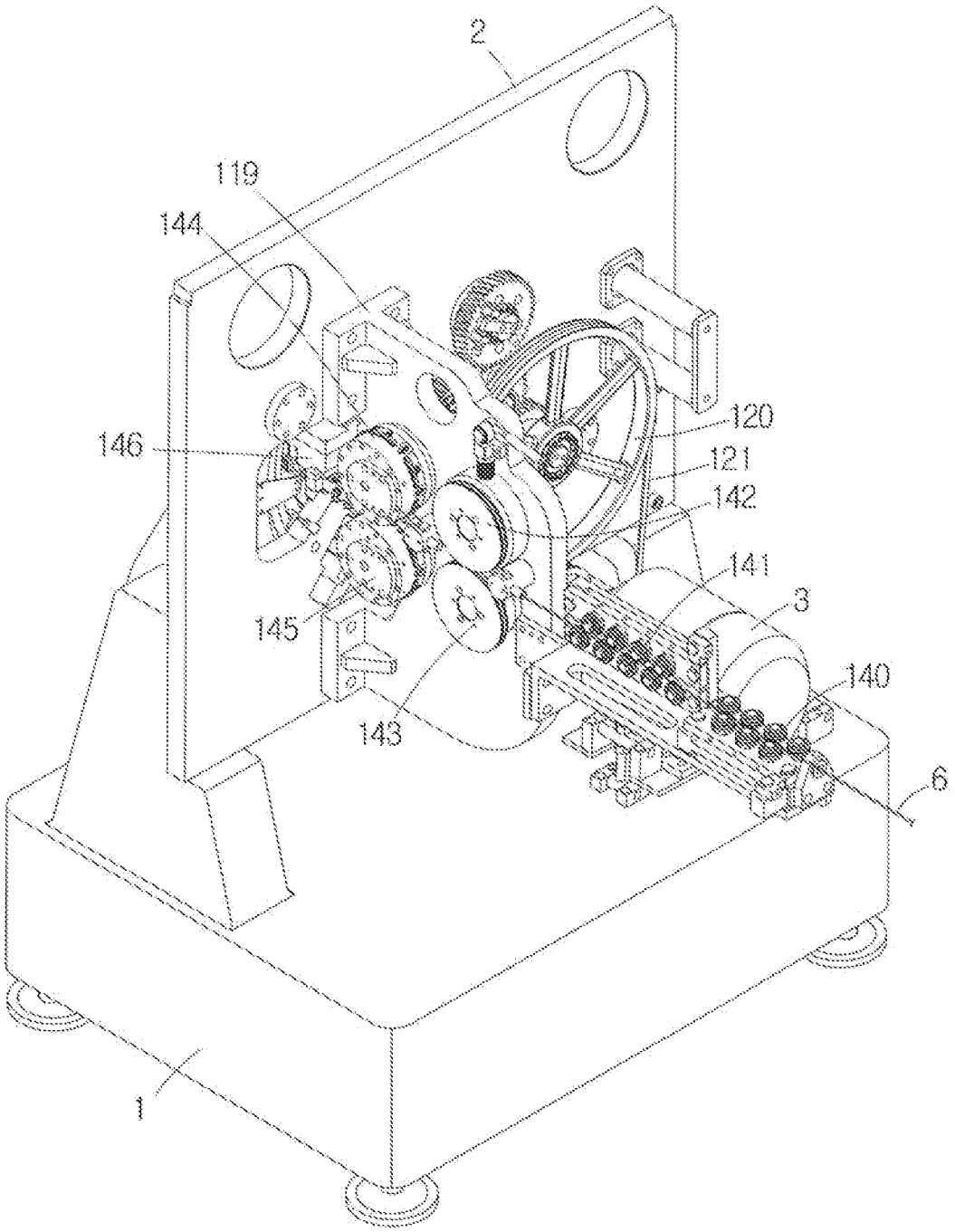
FIG. 2 is a rear perspective view illustrating the nail-making system according to the embodiment of the present invention when viewed from one direction.
Figure 3:
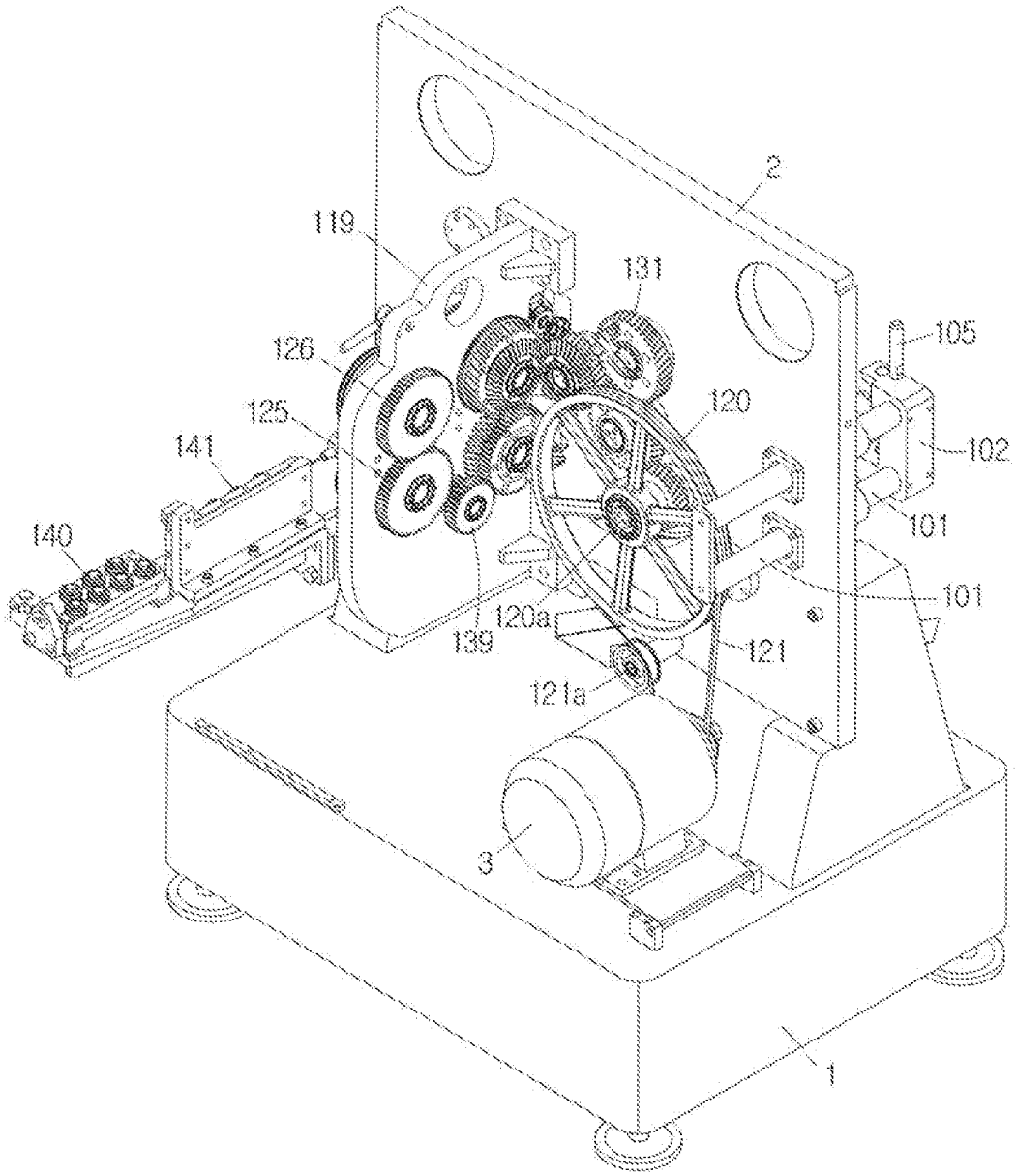
FIG. 3 is a rear perspective view illustrating the nail-making system according to the embodiment of the present invention when viewed from another direction.
Figure 4:
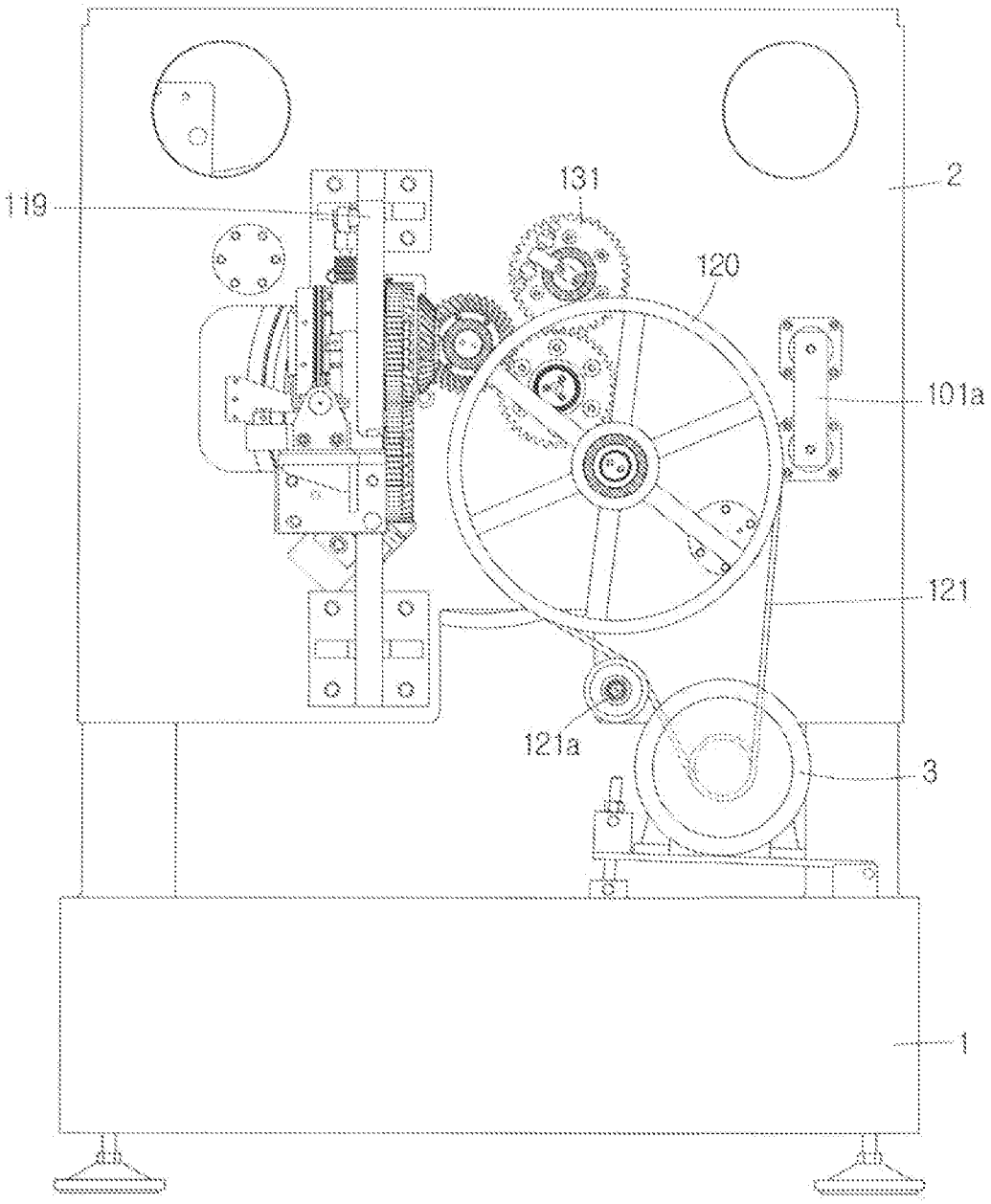
FIG. 4 is a rear view illustrating the nail-making system according to the embodiment of the present invention.
Figure 37:
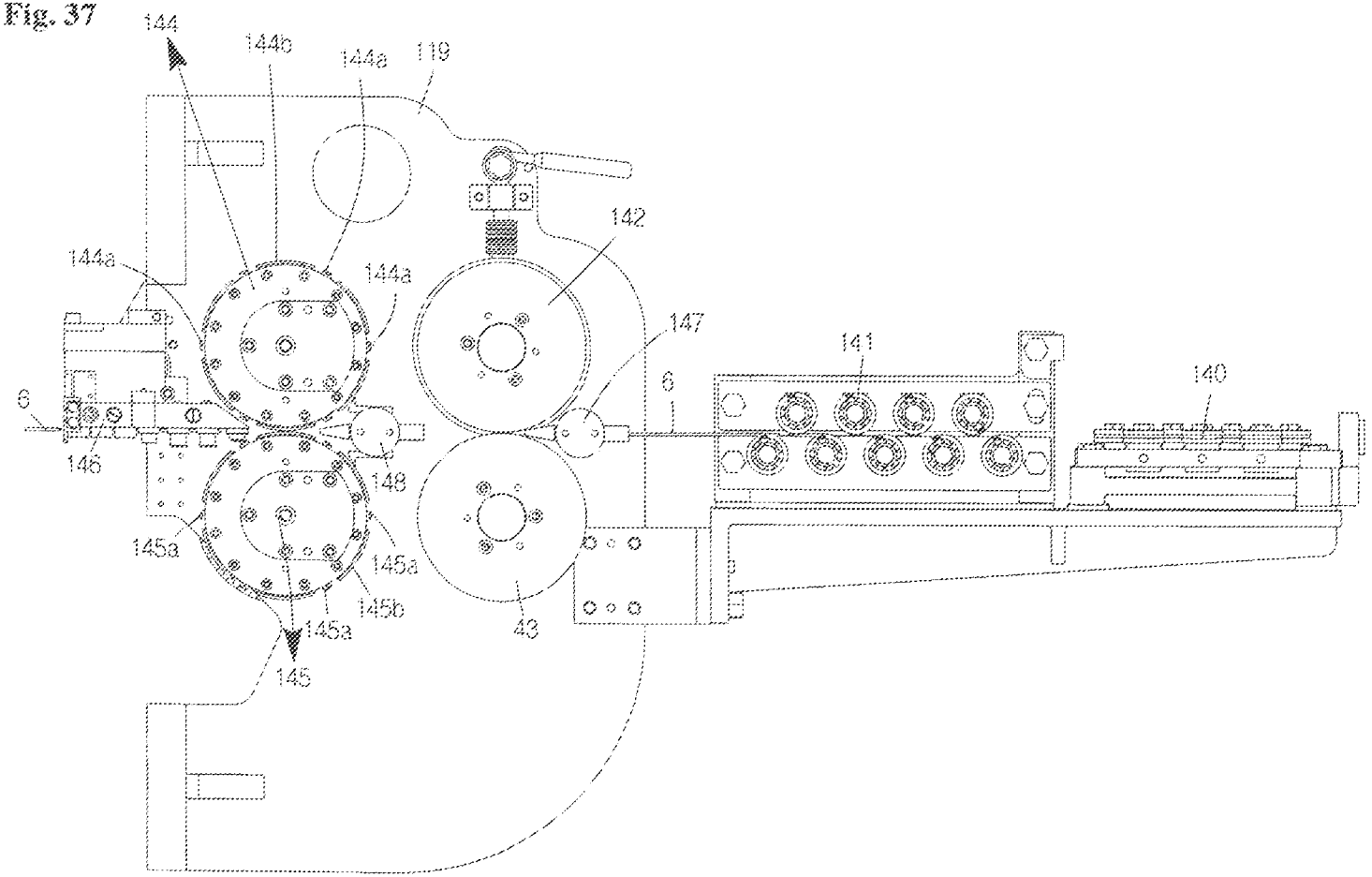
FIG. 37 is a front view illustrating steel wire transfer rollers, steel wire-cutting rollers, and a high-speed feeding portion, configured to feed the cut steel wire piece to the inner wheel at high speed, of the nail-making system according to the embodiment of the present invention.

As illustrated in FIGS. 2 and 37, the steel wire 6 is corrected into a linear state through a horizontal correction roller 140 and a vertical correction roller 141, is controlled (adjusted) in feeding speed, that is, in cut length, by means of upper and lower transfer rollers 142 and 143, the rotational speed of which is controlled by means of a change gear 139, is cut to a predetermined length by means of a pair of cutters, which face each other vertically, among a plurality of cutters 144*a* and 145*a*, which are mounted on the outer surfaces of upper and lower cutting rollers 144 and 145, is introduced into the steel wire introduction portion 10 at high speed by means of a high-speed feeding portion 146, is clamped by the clamp 7 mounted to the inner wheel 4, and is transferred to the punching portion 15 along the inner wheel 4. The steel wire 6 is formed so as to have a needle-shaped portion 6*b* by being cut by the cutting rollers 144 and 145. A guide 144*b* is provided between adjacent ones of the cutters 144*a* on the outer circumferential surface of the upper cutting roller 144 so as to guide the transfer of the steel wire 6, and a guide 145*b* is provided between adjacent ones of the cutters 145*a* on the outer circumferential surface of the lower cutting roller 145 so as to guide the transfer of the steel wire 6. Guide member 147 and 148, which are configured to guide the transfer of the steel wire 6, are respectively provided at the entry region between the transfer rollers 142 and 143 and at the entry region between the cutting rollers 144 and 145.

Each of the horizontal correction roller 140 and the vertical correction roller 141 is composed of a plurality of correction rollers, each of which is freely rotatably mounted to a subsidiary base wall 119 and is provided in the outer circumferential surface thereof with a guide groove having a semicircular shape so as to guide the steel wire 6.

The high-speed and high-quality nail-making system according to the embodiment of the present invention is able to realize highly efficient productivity, in which 1,000 to 3,000 nails (each of which has a nail head having a predetermined shape) are produced per minute, by appropriately controlling the rotational speed of the inner wheel 4, and is able to arbitrarily control the length of the produced nails N to a desired length.

It is possible to produce a nail N having a desired length by controlling a feeding speed (or a transfer speed) of the steel wire 6 in such a manner as to control the rotational speed of the upper and lower transfer rollers 142 and 143.

When the rotational speed of the upper and lower transfer rollers 142 and 143 is increased, the length of the cut steel wire 6 is increased because the steel wire 6 extends lengthwise between the upper and lower cutting rollers 144 and 145 before the cutters of the upper and lower cutting rollers 144 and 145 move to the cutting position. On the other hand, when the rotational speed of the upper and lower transfer rollers 142 and 143 is decreased, the length of the cut steel wire 6 is decreased because the steel wire extends a short distance between the upper and lower cutting rollers 144 and 145.

Because the change gear, which is configured to rotate the upper and lower transfer rollers 142 and 143, is configured to change the rotational speed of the upper and lower transfer rollers 142 and 143 by being replaced with another change gear having a different gear ratio, it is possible to control the feeding speed of the steel wire 6. Of course, it is also possible to arbitrarily set the length of the produced nail N in such a manner as to control the transfer speed using a continuously variable transmission, in place of the above change gear.

The steel wire 6 may also have various diameters and lengths. For example, the diameter of the steel wire 6 may be about 3.0 mm, or within the range from 0.5 mm to 10 mm, and the length of the produced nail N may be 10 mm to 200 mm depending on the feeding speed of the steel wire 6. Of course, the length of the nail N may be greater or less than the exemplified length, or may be a length expressed as an integer value, or a length having an integer portion and a decimal portion.

By means of the punch 13, which is moved while gripping a portion of the outer circumferential surface of the front end of the steel wire 6 in the state in which the inner wheel die 5 is positioned closest to the corresponding outer wheel die 8 because the inner wheel 4 is eccentrically disposed in the outer wheel 8 so as to be close to the punching portion 15, and by means of a punch-pushing roller 18 configured to press the punch 13, the front end of the steel wire 6 is punched, thereby producing a high-quality nail N having a nail head 6*a*. The produced nail N is rotated along the inner wheel 4 in the state of being clamped, is unclamped by means of the ejector 14 so as to freely fall, and is then discharged along the sloped chute 22 through the discharge space 21 defined between the inner wheel 4 and the outer wheel 8.

According to the embodiment of the present invention, because the inside diameter of the outer wheel 8 is greater than the outside diameter of the inner wheel 4, and the number of outer wheel dies 9 mounted to the outer wheel 8 is greater than the number of inner wheel dies 5 mounted to the inner wheel 4 by one to five although the distance between adjacent inner wheel dies 5 mounted to the inner wheel 4 is equal to the distance between adjacent outer wheel dies 9*a* mounted to the outer wheel 8, the rotational orbit of the outer wheel 8 is greater than the rotational orbit of the inner wheel 4, as illustrated in FIG. 7. Consequently, the discharge space 14 is naturally defined between the inner wheel 4 and the outer wheel 8, and the nail N having the nail head 6*a* formed thereon is unclamped so as to freely fall and to be discharged by the ejector 14 provided in the discharge space 21.

Because the clamps 7 are provided on the outer circumferential surface of the inner wheel 4 at regular intervals, the steel wire piece 6, which is introduced into the inner wheel die through the steel wire introduction portion 10, is clamped by the clamp 7, and is moved at high speed along the inner wheel 4. Subsequently, the steel wire piece 6 is produced into the nail N formed with the nail head 6*a* having a predetermined shape, and is transferred to the discharge portion 126. Subsequently, the nail N is unclamped so as to fall and to be rapidly discharged to the outside of the inner wheel 4 and the outer wheel 8 by the ejector 14 provided in the discharge space 21.

FIG. 7 is a fragmentary front view of the inner wheel and the outer wheel 8. FIGS. 8 to 12 are views illustrating the inner wheel 4.

The inner wheel 4 includes a shaft pipe 23 fixed to the front surface of the base wall 2, an inner wheel disc 25 mounted on the outer surface of the shaft pipe 23 so as to be rotatable about the axis via a ring bearing 24, a ring gear 26 fixed to the rear surface of the inner wheel disc 25, the plurality of inner wheel dies 5 and the plurality of clamps 7, which are mounted on the outer circumferential surface of the inner wheel disc 25 at regular intervals, and a fixing ring 27 and a fastener 28, which are configured to fix the ring bearing 24.

The ring gear 26 is engaged with a small-sized gear 26*a* for speed reduction, and the small-sized gear 26*a* is connected to the motor 3 via a power transmission unit so as to transmit the rotative force having the reduced speed to the inner wheel 4, thereby rotating the inner wheel 4 in one direction.

Each of the inner wheel dies 5 is configured to have the shape of a trapezoid in which the upper side thereof is smaller than the lower side thereof, and is provided in the center thereof with a gripping groove 5*a* having a semicircular or semi-elliptical section so as to receive the steel wire piece 6. The gripping groove 5*a* is provided with a plurality of press protrusions 5*b* at predetermined intervals so as to securely grip the front end of the steel wire piece 6, thereby preventing the steel wire piece 6 from being moved back when punching is performed in order to form the nail head 6*a*.

Because the press protrusion 5*b* has an inside diameter smaller than the diameter of the steel wire piece 6, the press protrusion 5*b* securely grips the front end of the steel wire piece 6 in cooperation with the outer wheel die 9. In other words, because the press protrusion 5*b* bites into the surface of the front end of the steel wire piece 6 and thus forcibly grips the surface of the front end, it is possible to prevent the steel wire piece 6 from being moved back while being punched.

The two ends of the gripping groove 5*a* are respectively provided with enlarged taper surfaces 5*c* so as to allow the steel wire piece 6 to be easily introduced into the gripping groove 5*a*.

The inner wheel dies 5 are fixed to a stepped portion 30 of the inner wheel disc 25 at regular intervals by means of fixing elements 29.

Each of the fixing elements 29 is fastened to a sloped threaded hole 31 formed in the stepped portion 30 via a fastening element 32. The fastening element 32 is inserted into a through hole 33, which is obliquely formed in the center of the fixing member 29, and is then engaged with the sloped threaded hole 31 in the stepped portion 30.

The fastening element 32 may be fastened to the sloped threaded hole 31 in the state of being fitted into a sleeve 34.

The two lateral sides of the inner wheel die 5 are provided with respective sloped surfaces 5*d* such that the distance between the sloped surfaces 5*d* increases moving outwards, and the two lateral sides of the fixing member 29 are respectively provided with sloped surfaces 29*a* such that the distance between the sloped surfaces 29*a* decreases moving inwards, thereby securely fixing the inner wheel die 5 to the inner wheel 4.

Because a predetermined distance 29*h* is maintained between the bottom surface of the fixing member 29 and the stepped portion 30, the fixing member 29, which has a wedge-shaped structure, presses and supports at both lateral sloped surfaces thereof two adjacent inner wheel dies 5 for secure fixation of the inner wheel dies 5.

FIGS. 13 to 17 illustrate the clamp 7, which is mounted on the outer circumferential surface of the inner wheel 4. The clamp 7 is fitted and mounted in each of a plurality of shaft holes 35, which are formed in the inner wheel 4 toward the center of the inner wheel 4 at regular intervals, and each of which has a predetermined depth.

The clamp 7 includes a cylindrical pipe 36 having a coupling hole 44, which is longitudinally formed and is open upwards, and an actuating lever 37, which projects in one direction from the upper surface of the cylindrical pipe 36 and has a flat surface 37*a*. An elastic body 41, which is surrounded at the outer circumferential surface thereof by a torsion spring 38 and which has an elastic support portion 39 having a flat surface 40 at one side thereof, is fitted into the shaft hole 35, and is fixed at the lower portion thereof to the cylindrical pipe 36 using screw nails 42, whereby the cylindrical pipe 36 and the elastic body 41 are integrally fixed to each other and are rotated in a forward direction or a reverse direction together with each other.

Figure 18:
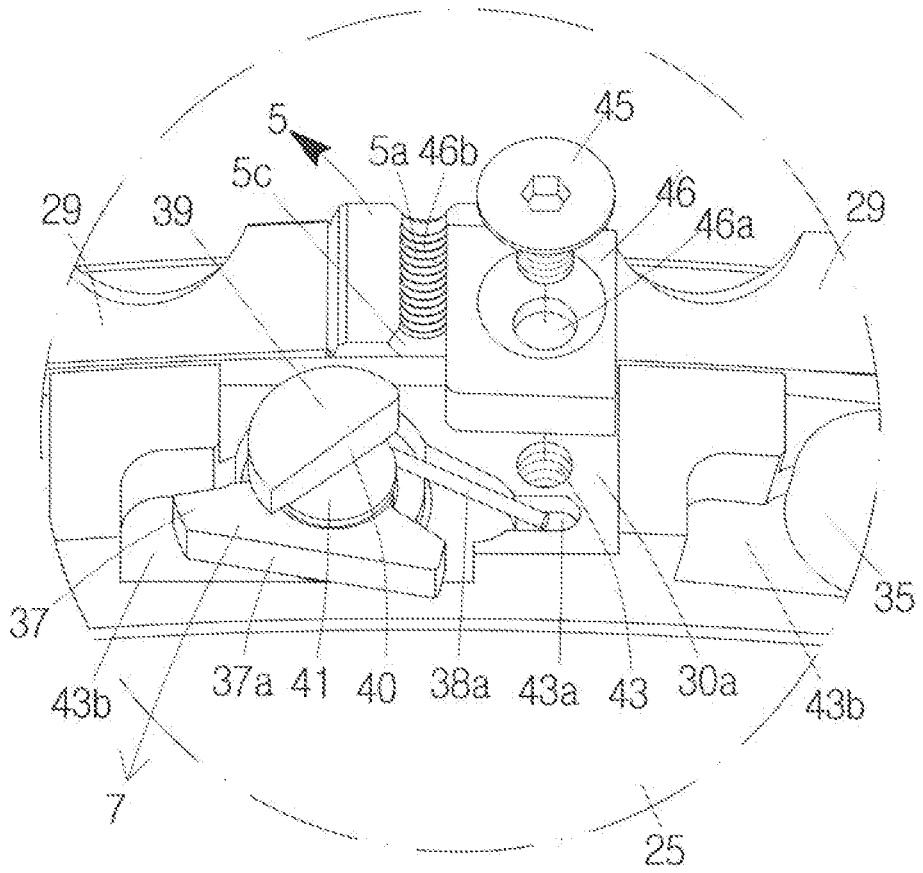
FIG. 18 is a perspective view illustrating the mounted state of the clamp of the nail-making system according to the embodiment of the present invention.

A lower end protrusion 38*b* of the torsion spring 38, which is disposed in the coupling hole 44, is fitted and fixed in a fixing groove 44*a* formed in the bottom of the coupling hole 44, and the cylindrical pipe 36 is fitted into each of the plurality of shaft holes 35, which are formed in the outer circumferential surface of the inner wheel 4 at regular intervals. Subsequently, an upper end protrusion 38*a* of the torsion spring 38 is inserted into a depressed groove 43*a* formed in the outer circumferential surface of the inner wheel 4, and is inserted into a through hole 46*a* in a support plate 46, which supports a lateral side portion of the steel wire piece 6, and a screw nail 45 is threadedly engaged with a threaded hole 43 formed in the outer circumferential surface of the inner wheel 4 through a through hole 46*a* in the support plate 46, as illustrated in FIG. 18. As a result, since the support plate 46 is fixed to the outer circumferential surface 43*b* of the inner wheel 4 and the upper end protrusion 38*a* inserted in the depressed groove 43*a* is covered by the support plate 46, the clamp 7 is elastically supported, and is prevented from being separated from the shaft hole 35.

Figure 19:
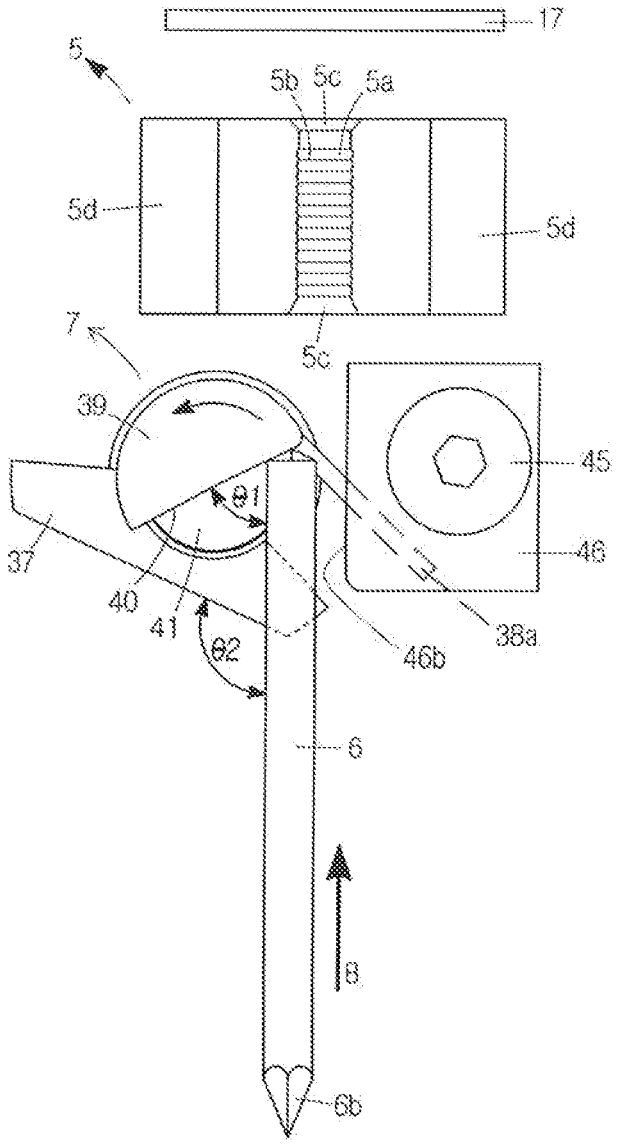
FIG. 19 is a plan view illustrating the state in which a steel wire piece is introduced between the clamp and an inner die of the nail-making system according to the embodiment of the present invention.
Figure 20:
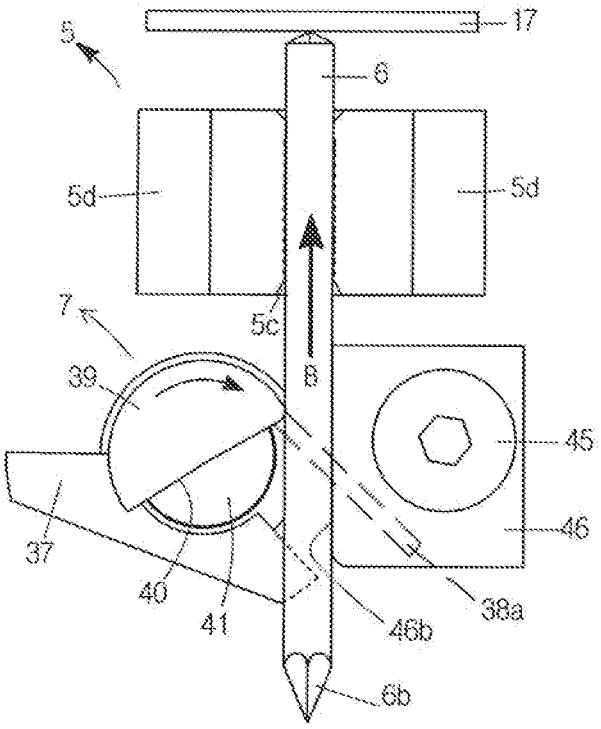
FIG. 20 is a plan view illustrating the state in which the steel wire piece is introduced and clamped between the clamp and the inner die of the nail-making system according to the embodiment of the present invention.
Figure 21:
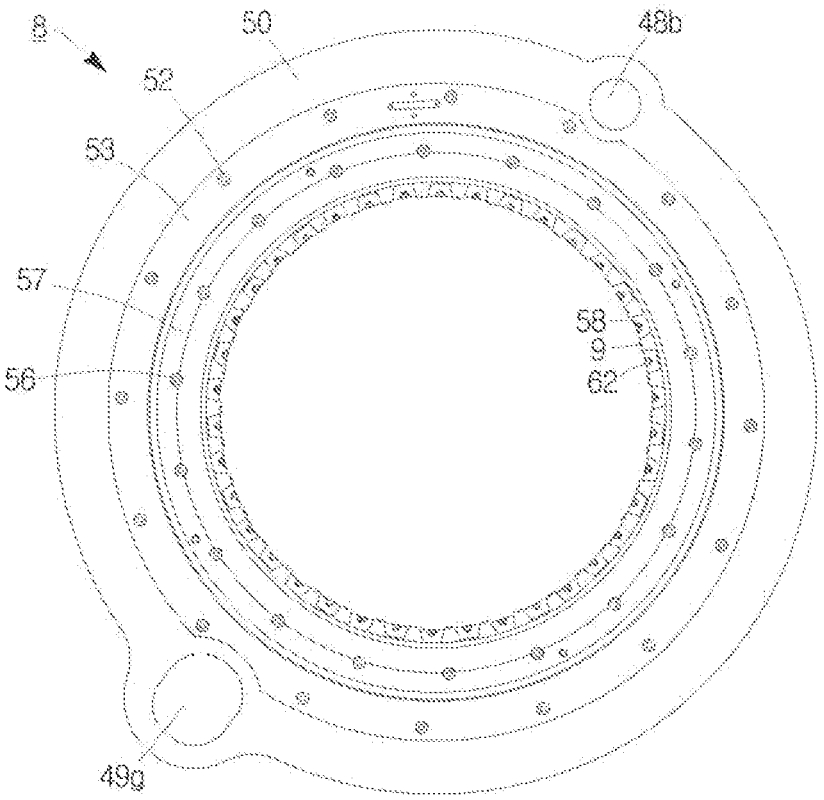
FIG. 21 is a front view illustrating an outer wheel of the nail-making system according to the embodiment of the present invention.
Figure 22:
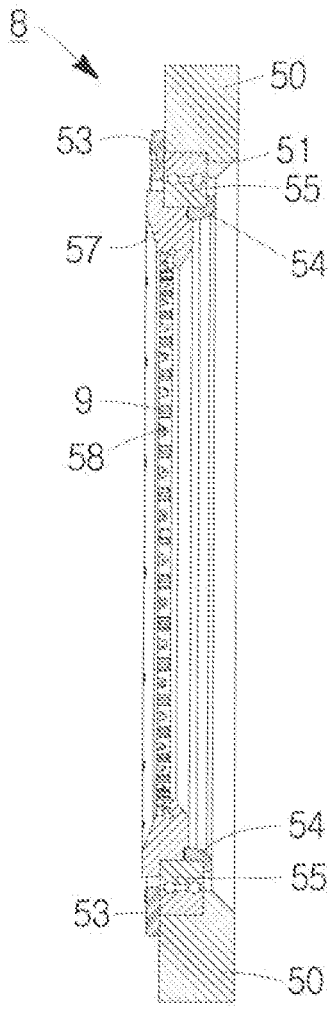
FIG. 22 is a cross-sectional view illustrating the outer wheel of the nail-making system according to the embodiment of the present invention.
Figure 45:
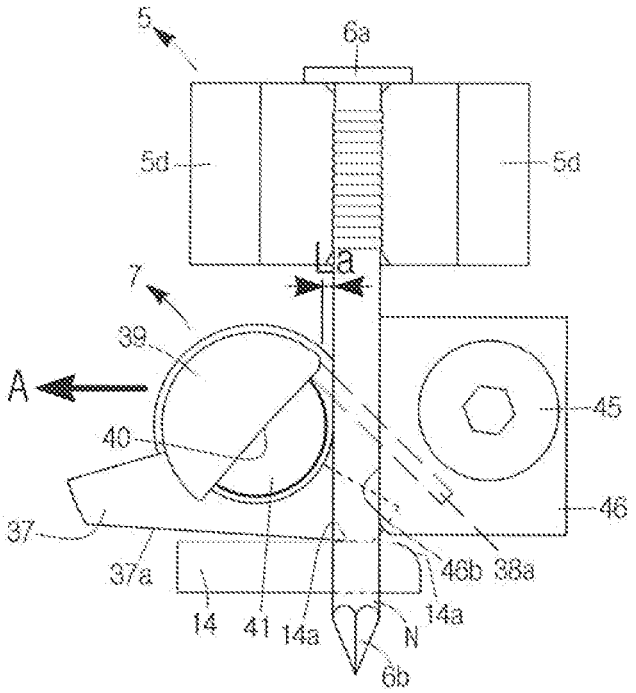
FIG. 45 is a plan view illustrating the state after the clamped steel wire piece is unclamped by the ejector according to the embodiment of the present invention.

As illustrated in FIG. 19, because the flat surface 40 of the elastic body 41, which is elastically supported by the torsion spring 38, is maintained at an angle of about 45 degrees (θ1) relative to the direction of the introduced steel wire piece 6 or in a direction (a "B" direction) in which the steel wire piece 6 is introduced, the front end of the steel wire piece 6, which is introduced by a force exceeding the elastic force of the torsion spring 38, presses the flat surface 40 to rotate the elastic body 41 in a counterclockwise direction. As illustrated in FIG. 20, the steel wire piece 6, which is introduced more deeply, is moved above the gripping groove 5*a* in the inner wheel die 5, and is stopped by the stopper 17. At the same time, the steel wire piece 6 is elastically supported and clamped in the space 39*a* defined between the lateral side surface 46*b* of the support plate 46 and the elastic support portion 39, which is elastically supported in a clockwise direction. As illustrated in FIG. 45, because the flat surface 37*a* of the actuating lever 37 is maintained at an angle (θ2) in a range from 100 to 140 degrees with respect to the direction in which the steel wire piece 6 is introduced (the "B" direction), the ejector 14 pushes the actuating lever 37 to rotate the elastic body 41 in a counterclockwise direction, whereby the elastic support portion 39, which is forcibly gripping the steel wire piece 6, is moved away from the steel wire piece 6 by a distance La, and the steel wire piece 6 is thus unclamped.

The degrees θ1 and θ2 may be changed by adjusting the fixing location when the elastic body 41 is fixed to the cylindrical pipe 36 using the screw nails 42.

FIGS. 21 to 24 illustrate the outer wheel 8. The outer wheel 8 includes a ring base 50 mounted on the front surface of the base wall 2, a ring bearing 55 mounted to a stepped portion 51 of the ring base 50 by means of fastening elements 52 and fixing ring 53 and 54, an outer wheel disc, which is fastened to the front surface of the ring bearing 55 so as to be freely rotatable using fastening elements 56, a plurality of outer wheel dies 9, which are fixed to the inner circumferential surface of the outer wheel disc 57 at regular intervals, and fixing members 58 fixing the outer wheel dies 9 to the outer wheel disc 57.

Each of the outer wheel dies 9 is configured to have the shape of a trapezoid in which the upper side thereof is larger than the lower side thereof, and is provided in the center of the lower surface thereof with a gripping groove 9*a* having a semicircular or semi-elliptical section so as to receive the steel wire piece 6. The gripping groove 9*a* is provided with a plurality of press protrusions 9*b* at predetermined intervals so as to securely grip the front end of the steel wire piece 6, thereby preventing the steel wire piece 6 from being moved back when punching is performed in order to form the nail head 6*a*.

The two ends of the gripping groove 9*a* are respectively provided with enlarged taper surfaces 9*c* so as to allow the steel wire piece 6 to be easily introduced into the gripping groove 9*a*.

Because the press protrusion 9*b* has an inside diameter smaller than the diameter of the steel wire piece 6, the press protrusion 9*b* securely grips the front end of the steel wire piece 6 in cooperation with the inner wheel die 5. In other words, because the press protrusion 9*b* bites into the surface of the front end of the steel wire piece 6 and thus forcibly grips the surface of the front end, it is possible to prevent the steel wire piece 6 from being moved backwards while being punched.

The outer wheel dies 9 are fixed to the stepped portion 60 of the outer wheel disc 57 at regular intervals by means of the fixing members 58.

Each of the fixing elements 29 is fastened to a sloped threaded hole 31 formed in the stepped portion 30 via a fastening element 32. The fastening element 32 is inserted into a through hole 33, which is obliquely formed in the center of the fixing member 29, and is then engaged with the sloped threaded hole 31 in the stepped portion 30.

Each of the fixing members 58 is fixed into a sloped threaded hole 61 formed in the stepped portion 60 using a fastening element 62. The fastening element 62 is first inserted into a through hole 63, which is obliquely formed in the center of the fixing member 58, and is then fastened to the sloped threaded hole 61 in the stepped portion 60.

The fastening element 62 may be fastened to the sloped threaded hole 63 in the state of being fitted into a sleeve 64.

The two lateral sides of the outer wheel die 9 are respectively provided with sloped surfaces 9*d* such that the distance between the sloped surfaces 9*d* becomes narrow moving inwards, and the two lateral sides of the wedge-shaped fixing member 58 are respectively provided with sloped surfaces 58*a* such that the distance between the sloped surfaces 59*a* becomes wide moving outwards, thereby securely fixing the inner wheel die 50 to the inner wheel 4. Furthermore, because a predetermined distance 58*h* is maintained between the stepped portion 60 and the fixing member 58, the outer wheel die 9 is securely fixed to the outer wheel 8.

If the gripping groove 5*a* in the inner wheel die 5 does not face and is thus not aligned with the gripping groove 9*a* in the outer die 9 at the punching portion 15, because the outer surface of the front end of the steel wire piece 6 is not uniformly gripped, there is a problem in which a punching error or abnormal shaping of the nail head 6*a* occurs or the outer surface of the front end of the steel wire piece 6 is scratched by the inner and outer wheel dies 5 and 9, thereby deteriorating merchantability.

Accordingly, the embodiment of the present invention further includes an outer wheel adjustment unit, configured to cause the gripping groove 5*a* in the inner wheel die 5 to face and be aligned with the gripping groove 9*a* in the outer wheel die 9, both of which are positioned at the punching portion 15, by finely moving the outer wheel 8.

Figure 23:
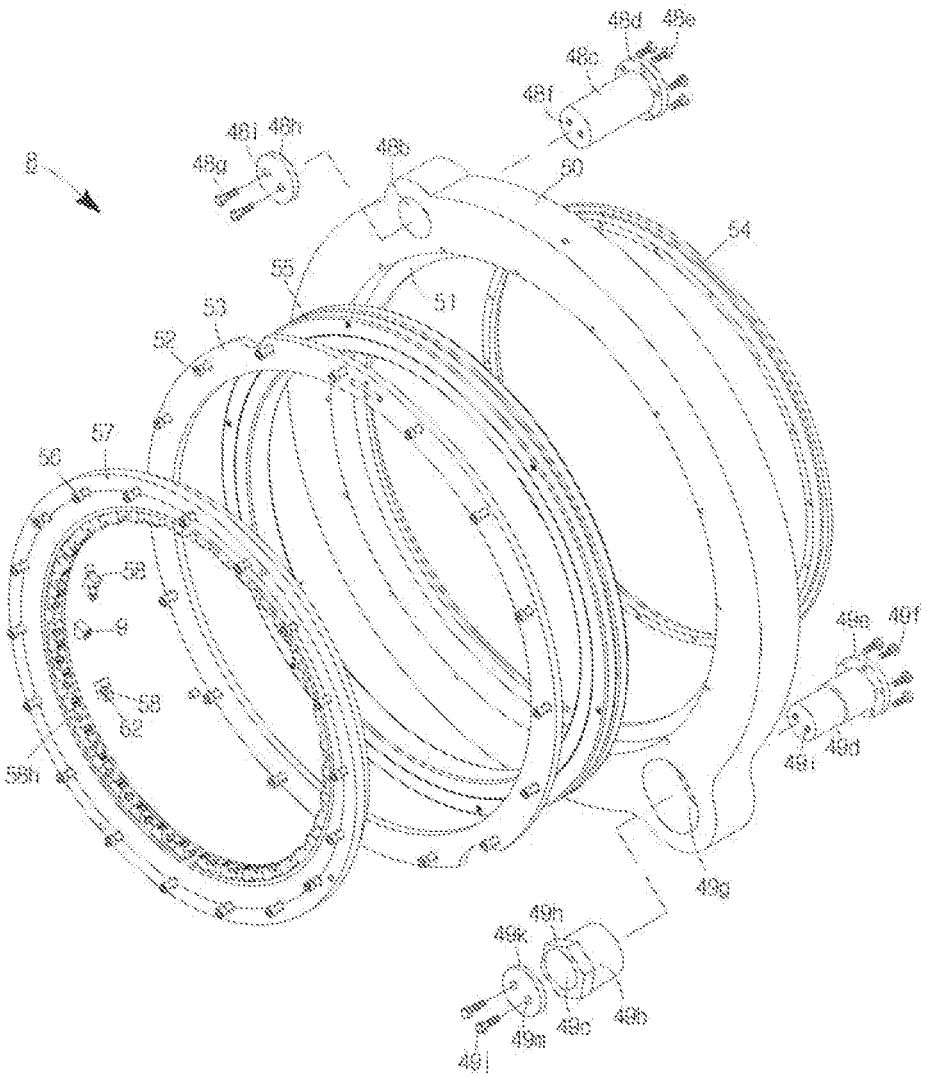
FIG. 23 is an exploded perspective view illustrating the outer wheel of the nail-making system according to the embodiment of the present invention.
Figure 24:
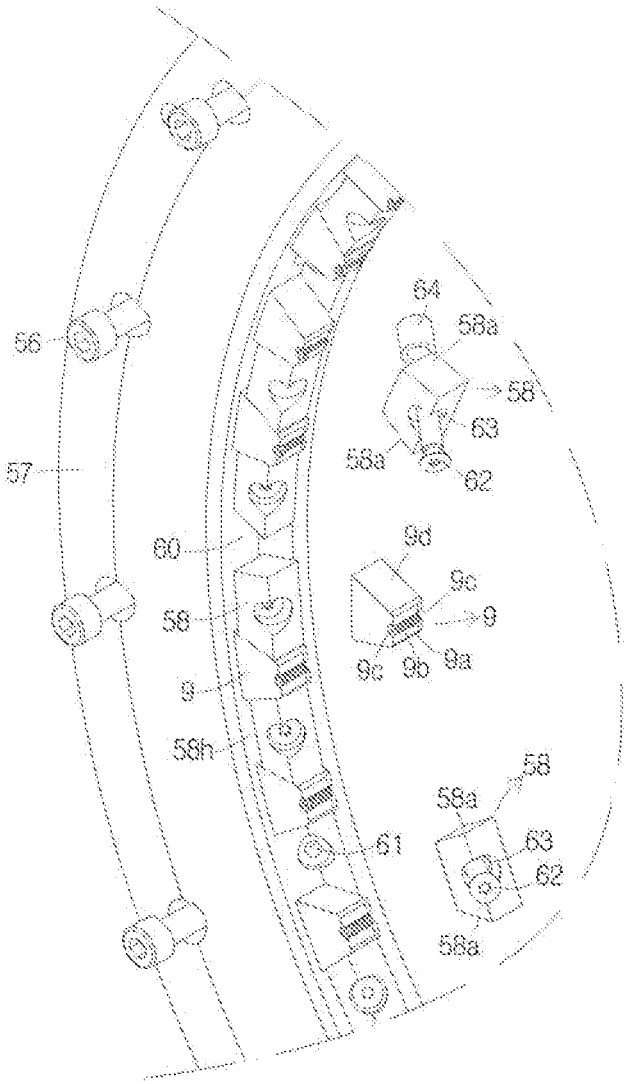
FIG. 24 is an enlarged perspective view illustrating a portion of the outer wheel of the nail-making system according to the embodiment of the present invention.
Figure 25:
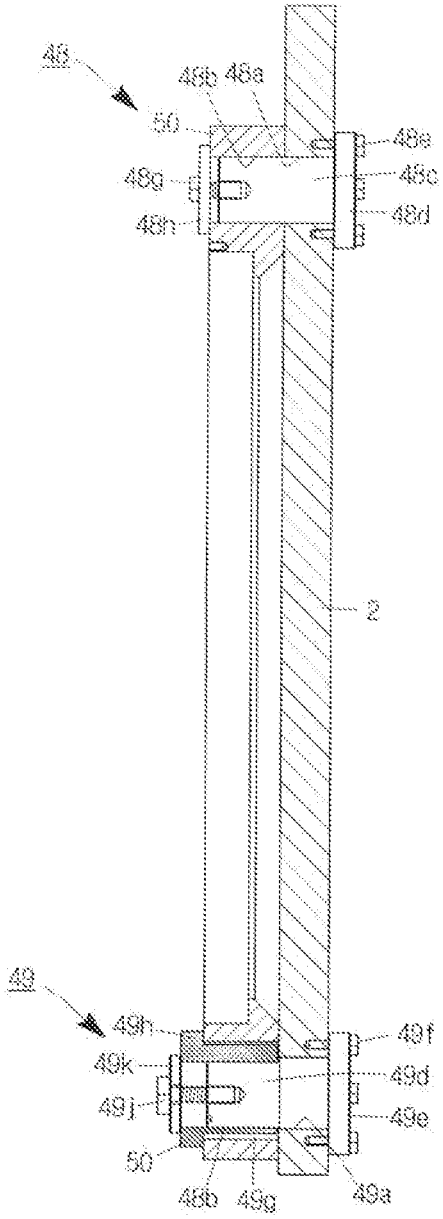
FIG. 25 is an enlarged perspective view illustrating an outer wheel adjuster of the nail-making system according to the embodiment of the present invention.
Figure 26:
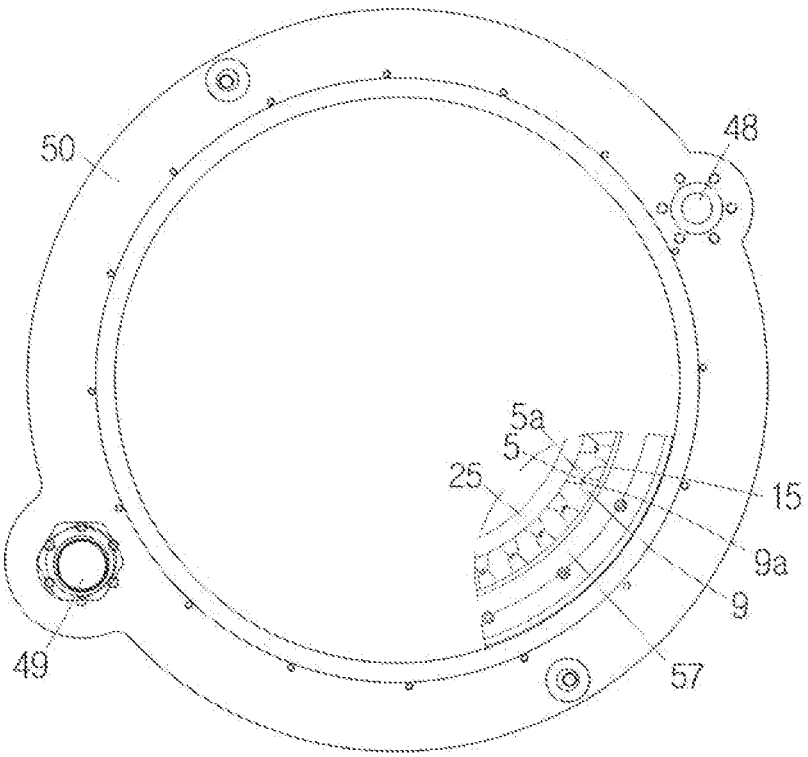
FIG. 26 is a front view illustrating the outer wheel adjuster of the nail-making system according to the embodiment of the present invention in the state in which the position of an outer wheel die is not corrected.
Figure 35:
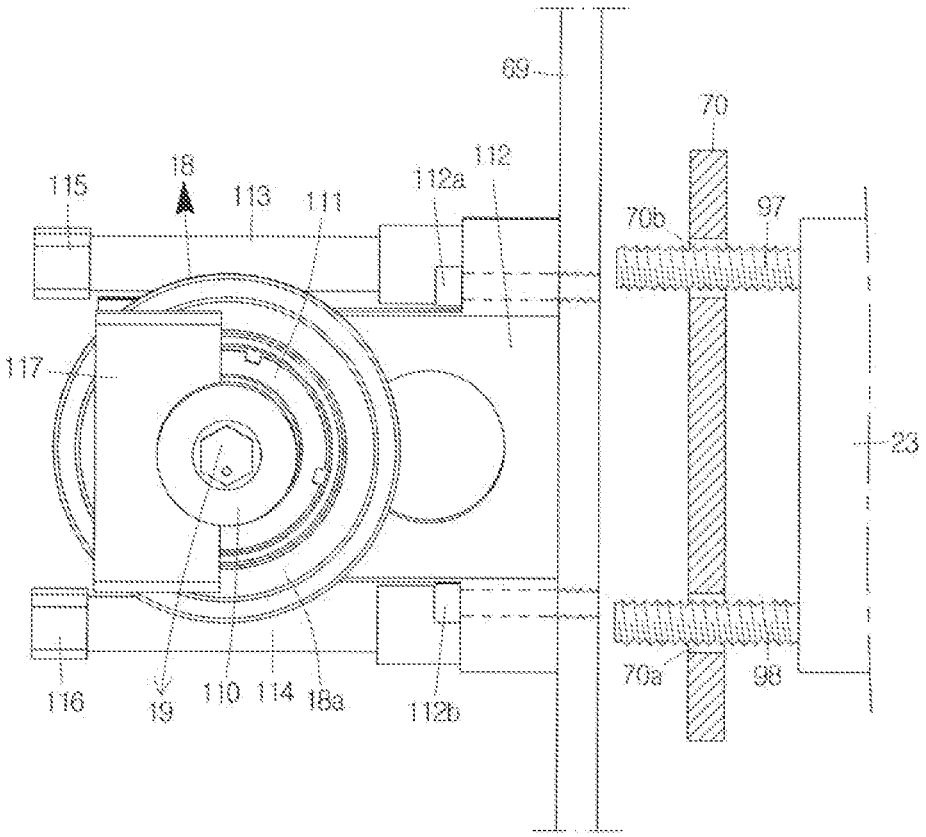
FIG. 35 is a front view illustrating a portion of a punch push roller of the nail-making system according to the embodiment of the present invention.

As illustrated in FIGS. 23 and 35, the outer wheel adjustment unit includes a shaft pin 48, configured to rotatably support the upper portion of the outer wheel 8, and an outer wheel adjuster 49, configured to finely move the outer wheel die 9 while supporting the opposite lower portion of the outer wheel 8.

The shaft pin 48 includes a shaft portion 48*c*, which has a predetermined outside diameter and is fitted into a through hole 48*a* in the base wall 2 and a shaft hole 48*b* in the outer wheel 8, a flange portion 48*d* formed at the rear end of the shaft portion 48*c*, a plurality of bolts 48*e* configured to fasten and fix the flange portion 48*d* to the base wall 2, a plurality of threaded holes 48*f* formed in the front surface of the shaft portion 48*c*, a plurality of bolts 48*g* configured to be fastened into the threaded holes 48*f*, and through holes 48*i* in a washer 48*h* into which the bolts 48*g* are inserted. The length of the shaft portion 48*c* may be equal to or slightly less than the sum of the thickness of the base wall 2 and the thickness of the outer wheel 8.

The shaft portion 48*c* is first fitted into the through hole 48*a* formed in the upper portion of the base wall 2 so as to project from the front surface of the base wall 2, and the flange portion 48*d* is fastened and fixed to the base wall 2 by means of the plurality of bolts 48*e*. The portion of the shaft portion 48*c* that projects from the front surface of the base wall 2 is inserted into the shaft hole 48*b* formed through the upper portion of the outer wheel 8, and the washer 48*h* is brought into surface contact with the front surface of the outer wheel 8. Subsequently, the bolts 48*g* are inserted into the plurality of through holes 48*i* formed through the washer 48*h*, and are threadedly engaged with the threaded holes 48*f* formed in the front surface of the shaft portion 48*c*, whereby the upper portion of the outer wheel 8 is rotatably supported by means of the shaft pin 48.

The outer wheel adjuster 49 includes a shaft portion 49*d*, which has a predetermined outside diameter and is fitted into the through hole 49*a* in the base wall 2 and a cavity 49*c* in an eccentric pipe 49*b*, a flange portion 49*e* formed at the rear end of the shaft portion 49*d*, a plurality of bolts 49*f* configured to fasten and fix the flange portion 49*e* to the base wall 2, a long hole 49*g*, which is formed through the opposite lower portion of the outer wheel 8 and into which the outer circumferential surface of the eccentric pipe 49*b* is fitted, a hexagonal protrusion 49*h*, which is formed at the front end of the eccentric pipe 49*b* and has an outside diameter greater than the inside diameter of the long hole 49*g*, a plurality of threaded holes 49*i* formed in the front surface of the shaft portion 49*d*, a plurality of bolts 49*j* fastened into the threaded holes 49*i*, and through holes 49*m* in a washer 49*k*, into which the bolts 49*j* are inserted and which has an outside diameter greater than the inside diameter of the cavity 49*c*. The length of the shaft portion 49*d* may be slightly less than the sum of the thickness of the base wall 2 and the thickness of the outer wheel 8.

The shaft portion 49*d* is fitted into the through hole 49*a* formed through the upper portion of the base wall 2 so as to project from the front surface of the base wall 2, and the outer surface of the eccentric pipe 49*b*, which is provided at the front end thereof with the hexagonal protrusion 49*h*, is fitted into the long hole 49*g* formed through the opposite lower portion of the outer wheel 8. Subsequently, the portion of the shaft portion 49*d* that projects from the front surface of the base wall 2 is rotatably fitted into the eccentric pipe 49*b*, and the washer 49*k*, which has an outside diameter slightly greater than the inside diameter of the eccentric pipe 49*b*, is brought into surface contact with the front surface of the hexagonal protrusion 49*h*. Thereafter, the bolts 49*j* are inserted into respective ones of the plurality of through holes 49*m* formed through the washer 49*k* and are fastened into the threaded holes 49*j* formed in the front surface of the shaft portion 49*d*, thereby fixing the lower portion of the outer wheel 8.

Figure 27:
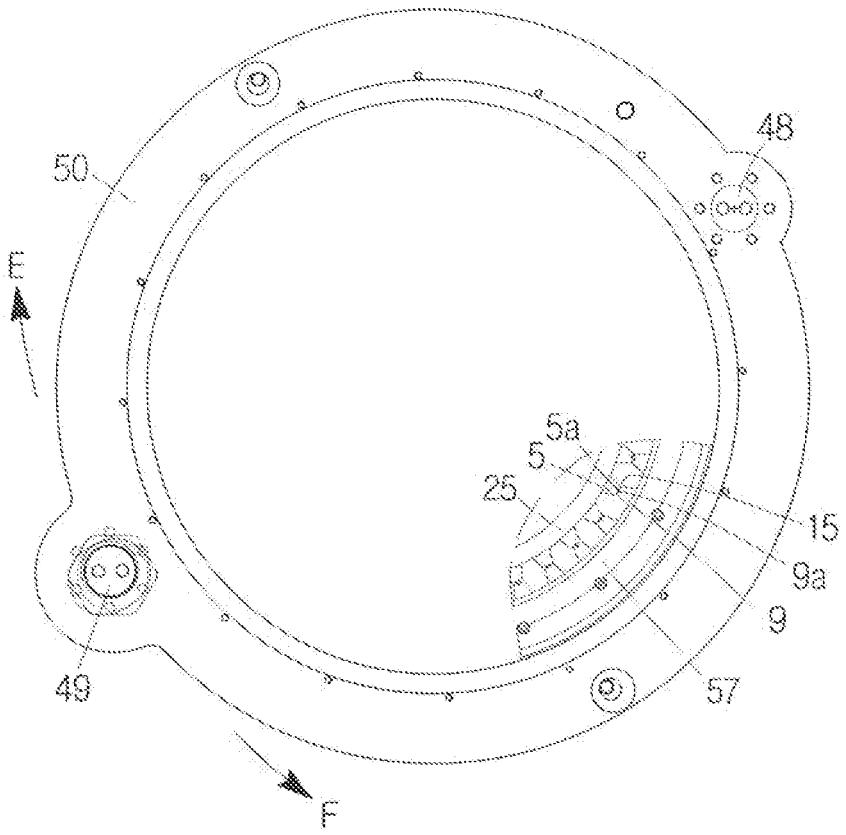
FIG. 27 is a front view illustrating the outer wheel adjuster of the nail-making system according to the embodiment of the present invention in the state in which the position of an outer wheel die is corrected.
Figure 28:
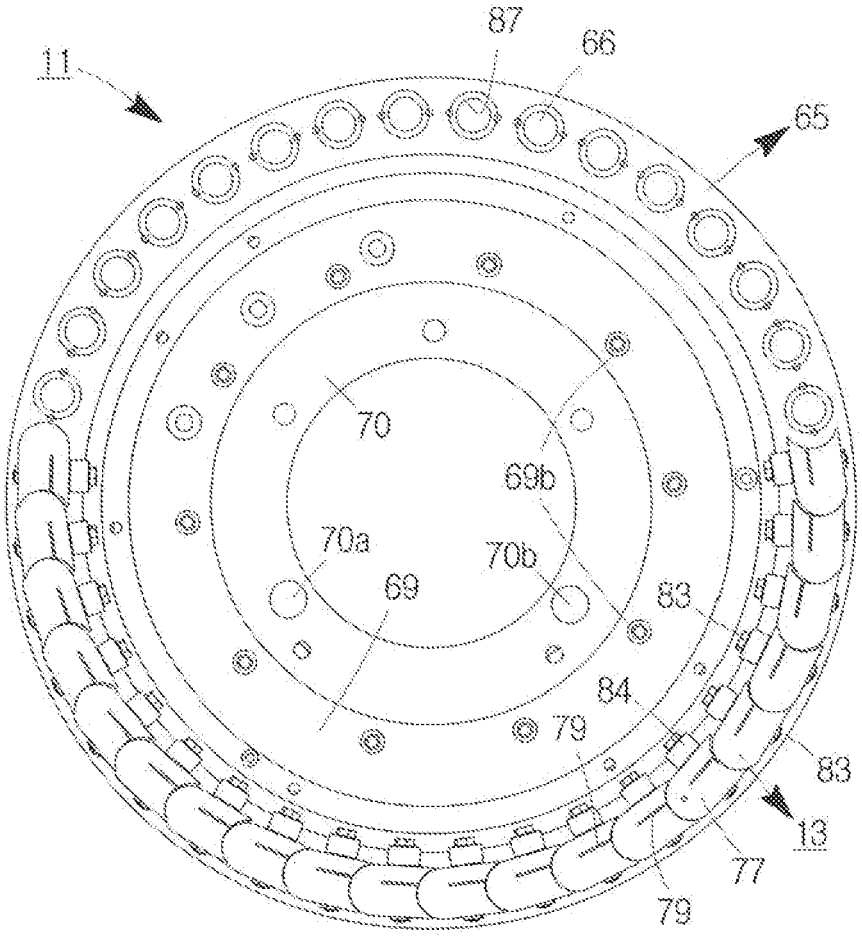
FIG. 28 is a front view illustrating a punching unit of the nail-making system according to the embodiment of the present invention from which a cylindrical cam and some of the punches are removed.
Figure 29:
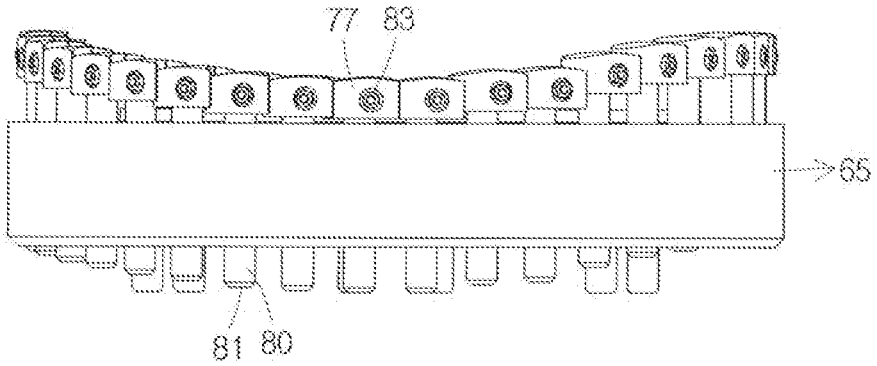
FIG. 29 is a plan view illustrating the punching unit of the nail-making system according to the embodiment of the present invention from which the cylindrical cam is removed.

When it is intended to correct (adjust) misalignment in which the gripping groove 5*a* in the inner wheel die 5 is not aligned with the gripping groove 9*a* in the outer wheel die 9, the plurality of bolts 49*j* are loosened, and the hexagonal protrusion 49*h* is then rotated using a tool (a tool capable of rotating the hexagonal bolts) such that the lower portion of the outer wheel 8 is finely moved in a counterclockwise direction (the "E" direction in FIG. 27) or in a clockwise direction (the "F" direction in FIG. 27) about the shaft pin 48 fitted in the upper portion of the outer wheel 8 due to the eccentricity of the eccentric pipe 49*b*. As a result of the adjustment, when the gripping groove 5*a* in the inner wheel die 5, which is moved to the punching portion 15, faces the gripping groove 9*a* in the outer wheel die 9 and is thus aligned with the gripping groove 9*a*, as illustrated in FIG. 27, the bolts 49*j*, which were loosened, are fastened so as to fix the lower portion of the outer wheel 8, whereby the position of the eccentric pipe 49*b* is fixed, and the ring base 50 is fixed to the front surface of the base wall 2 in the state of being in close contact therewith. Consequently, since the steel wire piece 6, which is transferred to the punching portion 15, is securely gripped at both sides thereof, the steel wire piece 6 is not moved back (the "B" direction, which is the direction in which the steel wire piece 6 is introduced) while being punched.

The shaft pin 48 may, of course, be fixed to the front surface of the base wall 2 by a process of welding the portion of the shaft pin 48 that projects from the front surface or the like.

By virtue of the outer wheel adjustment unit or the outer wheel adjuster, the gripping groove 9*a* in the outer wheel die 9 is brought close to the gripping groove 5*a* in the inner wheel die 5 so as to face the same and thus to be aligned therewith. The distance between the inner wheel die 5 and the outer wheel die 9 may be in a range from 0.5 mm to 5 mm so as to securely grip the steel wire piece 6 in the state in which the inner wheel die 5 does not contact the outer wheel die 9.

When the diameter of the steel wire piece 6 increases, it goes without saying that the distance between the inner wheel die 5 and the outer wheel die 9 may be greater than 5 mm.

Furthermore, by virtue of the outer wheel adjustment unit or the outer wheel adjuster 49, it is possible to adjust the outer wheel 8 such that the outer wheel 8 is passively rotated together with the inner wheel 4 by the steel wire piece 6 which is introduced into the steel wire introduction portion 10.

Specifically, because the distance between the end of the inner wheel die 5 and the end of the outer wheel die 9 is set to be slightly less than the diameter of the steel wire piece 6, which is introduced into the steel wire introduction portion 10, the end portion of the gripping groove 9*a* in the outer wheel die 9 is engaged with the outer surface of the steel wire piece 6, and the outer wheel 8 is rotated together with the steel wire piece 6 or the inner wheel 4 in the same direction.

The punching unit 11 is configured to be mounted on the front surface of the inner wheel 4 so as to be rotated together with the inner wheel 4. Furthermore, the punching unit 11 is configured to be removably coupled to the front surface of the inner wheel 4 so as to allow components such as the inner and outer wheel dies 5 and 9 and the clamp 7, which are internally disposed, to be checked, repaired, or replaced.

The punching unit 11 includes a cylindrical punching drum 65 having a predetermined thickness (or width), a plurality of guide holes 66, which are longitudinally formed through the peripheral portion of the punching drum 65 at regular intervals, rod bodies 80 of the punches 13, which are fitted into the guide holes 660 so as to be capable of reciprocating, a ring bearing 68, which is coupled into the cavity 67 in the punching drum 65 and has a cavity 68*a* formed in the center thereof, front and rear fixing plates 69 and 70 coupled to the inner circumferential surface of the ring bearing 68, a support ring 71 fixed to the rear surface of the punching drum 65, a plurality of projecting rods 73, which are fixed to the rear surface of the support ring 71 so as to project rearwards and which are coupled to coupling grooves 72 formed in the front surface of the inner wheel 4 so as to transmit the rotative force of the inner wheel 4 to the punching drum 65, a cylindrical cam 12 fixed to the front fixing plate 69, a cam groove 88 and an advancing cam groove 88*a* formed in the outer circumferential surface of the cylindrical cam 12, and the punches 13 configured so as to be linearly reciprocated by the cylindrical cam 12.

Since cam follower bearings 84 of the punches 13 are coupled to the cam groove 88 in the cylindrical cam 12 and are moved along the cam diagram defined by the cam groove 88 and the advancing cam groove 88*a*, it is possible to achieve linear reciprocating movement of the punches 13.

The cylindrical cam 12 and the front and rear fixing plates 69 and 70 are integrally fixed to one another by means of a plurality of bolts, and the punching drum 65 and the support ring 71, which are supported by the ring bearing 68, are fastened to each other by means of a plurality of bolts so as to be rotated together. The plurality of projecting rods 73 are mounted on the rear surface (back surface) of the support ring 71 at regular intervals, and are coupled into respective ones of the coupling grooves, which are formed in the inner wheel disc 25, so as to be rotated together with the inner wheel disc 25.

The guide holes 66 are configured to have the same number and interval as those of the inner wheel dies 5 mounted to the inner wheel 4 such that the punch 13, which is transferred to the punching portion 15 by the cylindrical cam 12, is moved toward the punching portion, the punch surface 81 punches the front end of the steel wire piece 6 by pressing of the punch push roller 18 to form the nail head 66, and the punch 13 is moved back beyond the advance punching cam groove 88*a* and the punching portion 15 and is continuously rotated together with the inner wheel 4.

Figure 30:
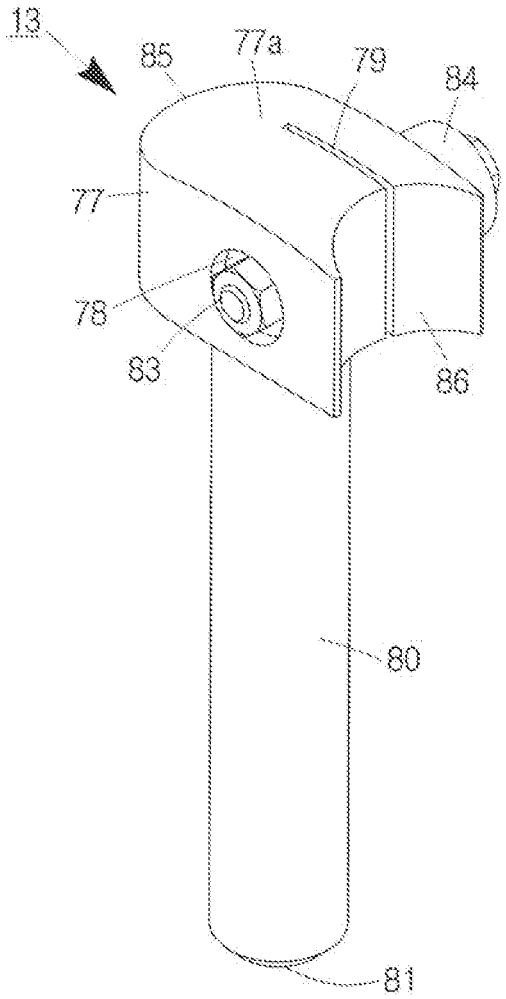
FIG. 30 is a perspective view illustrating a punch of the nail-making system according to the embodiment of the present invention.

As illustrated in FIG. 30, the punch 13 includes a coupling groove formed in the lower portion of the body 77 so as to be open downwards, a rod body 80, which is coupled at the upper end thereof into the coupling groove, a slit 79 formed in the body 77 in the longitudinal direction of the body 77, the punching surface 81 formed at the end (lower end) of the rod body 80, a bolt 82 and a nut 83, which are fitted into a fastening hole 78 formed through the body 77 with the slit 79 formed in the center of the body 77 and which presses the upper portion of the rod body 80 coupled into a coupling groove in the body 77 to fix the body 77 to the rod body 80, the cam follower bearing 84, which is coupled to the outer surface of the stepped portion of the bolt 82 so as to be freely rotatable and which is moved along the cam groove 88 so as to move the rod body 80 forwards and rearwards, and a semicircular projecting portion 85 and a semicircular recess portion 86, which are formed at the front and rear portions of the body 77 so as to allow the punch to be moved forwards and rearwards while maintaining the engagement between adjacent punches and preventing the cam follower bearing 84 from being separated from the cam groove 88.

The punching surface 81 may be a flat surface, a curved projecting surface or a curved depressed surface.

The inner circumferential surface of the guide hole 66, in which the rod body 80 is fitted, may be provided with a bushing or metal bearing 87 so as to reduce the motion resistance of the rod body 80.

The cylindrical cam 12 is configured to have the form of a ring having a predetermined thickness and width, and is fixed to the front surface of the punching unit 11. The outer circumferential surface of the cylindrical cam 12 is provided with the cam groove 88, into which the cam follower bearings 84 are coupled, and is provided at a region thereof in which the punching portion 15 is positioned with the advance cam groove 88*a* such that the cam follower bearing 84 maximally moves to the punching portion 15 to perform punching action.

The advance cam groove 88*a* is configured to have a curved shape and to be positioned closest to the punching portion 15. Accordingly, the cam follower bearing 84, which is moved to the advance cam groove 88*a*, is maximally moved forwards together with the associated punch 13. At this time, by the pressing action of the punch push roller 18, the front end of the steel wire piece 6, which is forcibly gripped by the inner and outer wheel dies 5 and 9, is pressed and punched into the nail head 6*a*, which has a normal shape.

Figure 31:
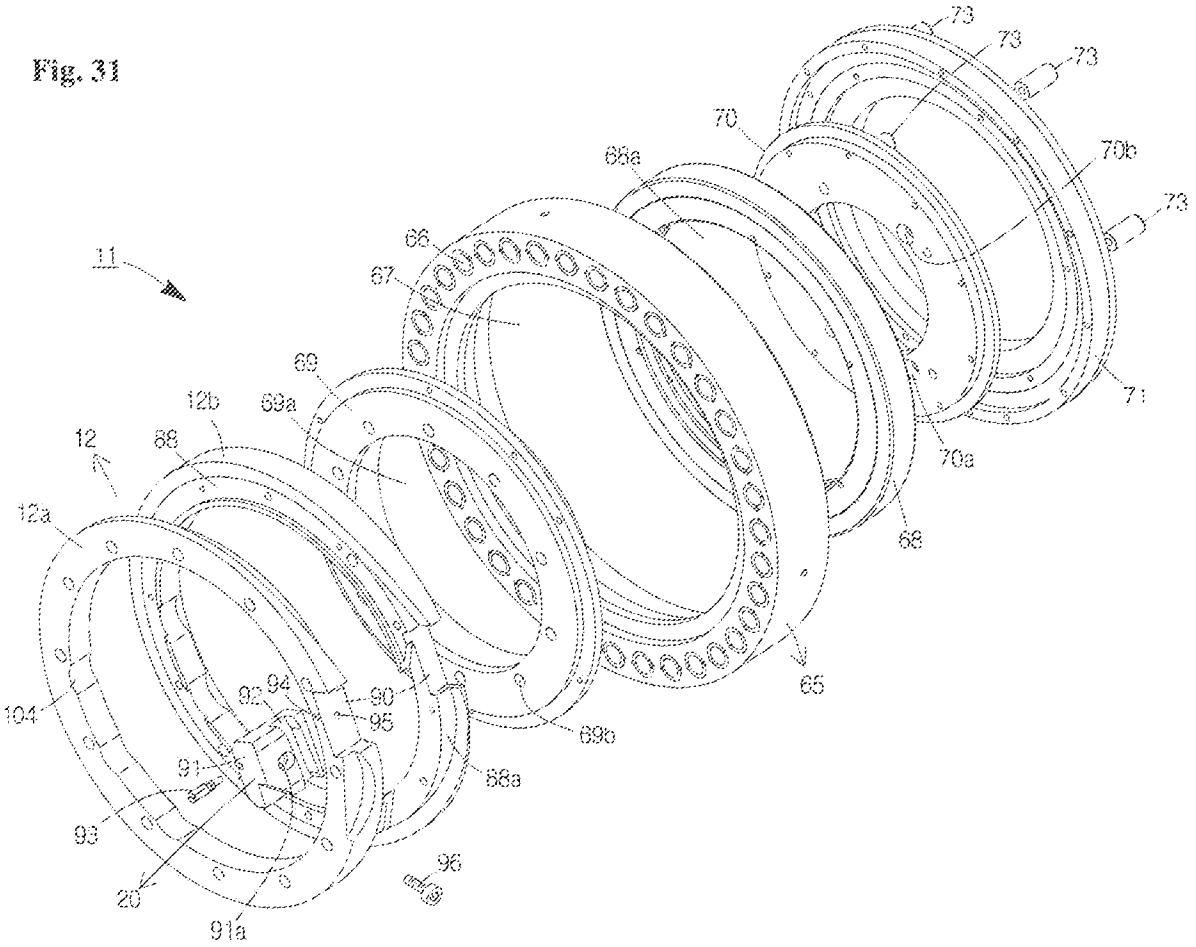
FIG. 31 is an exploded perspective view illustrating the punching unit of the nail-making system according to the embodiment of the present invention.
Figure 32:
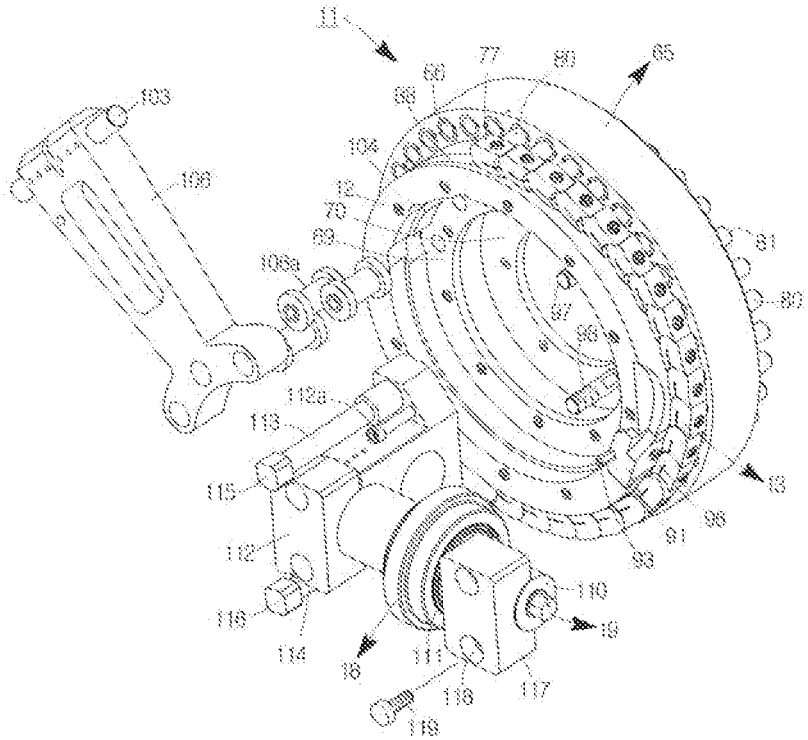
FIG. 32 is an exploded perspective view illustrating a fixing unit and an opening unit of the punching unit of the nail-making system according to the embodiment of the present invention.

As illustrated in FIG. 31, the cylindrical cam 12 may be composed of a pair of front and rear cams 12*a* and 12*b*, which are individually prepared and are then coupled to each other.

A region of the cylindrical cam 12, that is, a portion of the cylindrical cam 12 that corresponds to the zone between the steel wire introduction portion and the punching portion 15, may be provided with an adjustment cam 20 so as to set the thickness and/or size of the nail head 6*a* by adjusting the length of the introduced portion of the clamped steel wire piece 6.

The adjustment cam 20 includes a block 91 coupled into a coupling groove 90 formed in a region of the cylindrical cam 12, a subsidiary cam groove 92 formed in the block 91, an adjustment bolt 93 configured to finely move the block 91 close to or away from the punching portion 15, a threaded hole 94 with which the adjustment bolt 93 is threadedly engaged, and a bolt 96 configured to fasten and fix the block 91, which has been finely adjusted, into the threaded hole 95 in the subsidiary cam groove 92. The block 91 has formed therein a hole 91*a* into which the bolt 96 is inserted.

The punching unit 11 further includes a coupling unit, configured to couple the punching unit 11 to the inner wheel 4 so as to be rotated together with the inner wheel 4, and an opening unit, configured to open and close the punching unit 11 with respect to the inner wheel 4 via a hinge (a rotating shaft).

The coupling unit is configured to couple and fix the punching unit 11 to the front surface of the inner wheel 4 so as to enable the punching unit 11 to be rotated together with the inner wheel 4.

Figure 34:
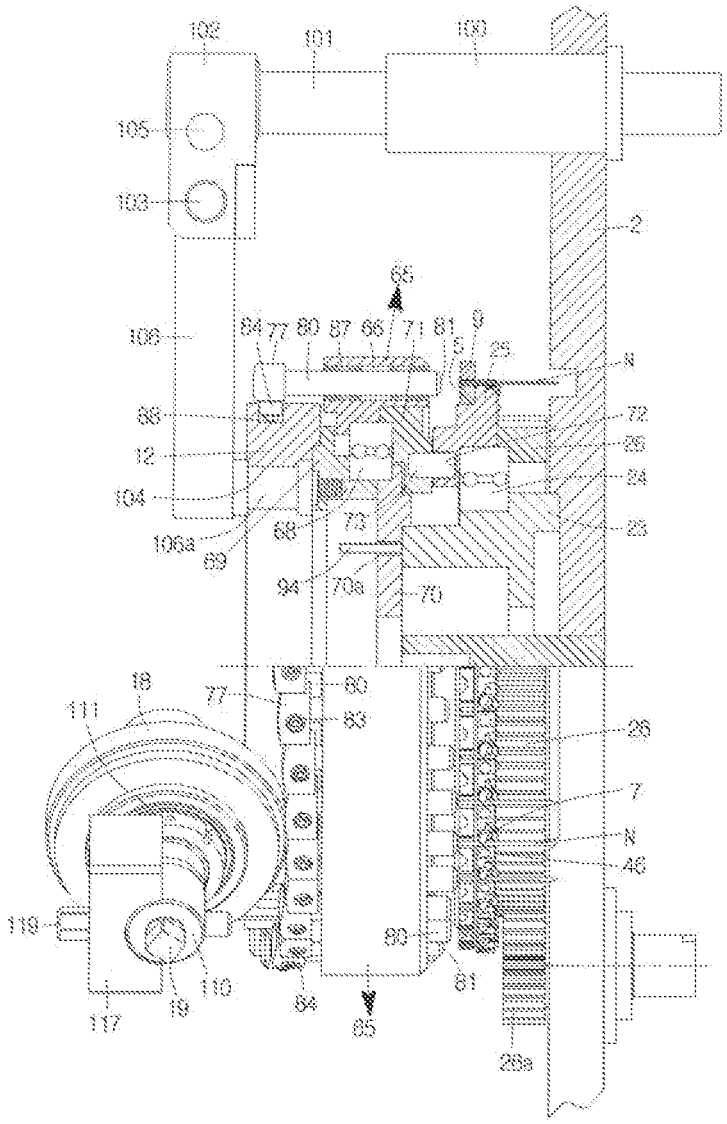
FIG. 34 is a cross-sectional view illustrating the nail-making system according to the embodiment of the present invention in the state in which the punching unit is coupled to the front surface of the inner wheel.

The coupling unit includes the plurality of projecting rods 73, which are fixed to the rear surface of the support ring 71 at regular intervals and project rearwards therefrom, and the plurality of coupling grooves 72 formed in the front surface of the inner wheel disc 25 at regular intervals so as to correspond to the projecting rods 73. As illustrated in FIG. 34, when the projecting rods 73 are coupled into the coupling grooves 72, the punching unit 11 is rotated together with the inner wheel 4 in the same direction.

Figure 33:
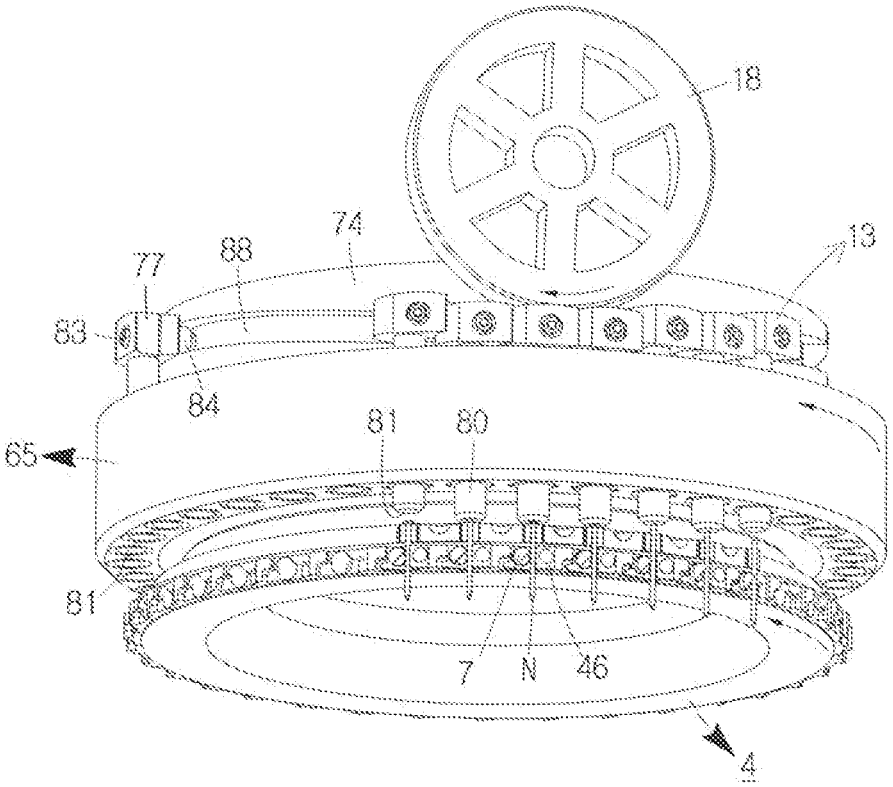
FIG. 33 is a perspective view illustrating operation of the punching unit of the nail-making system according to the embodiment of the present invention.
Figure 41:
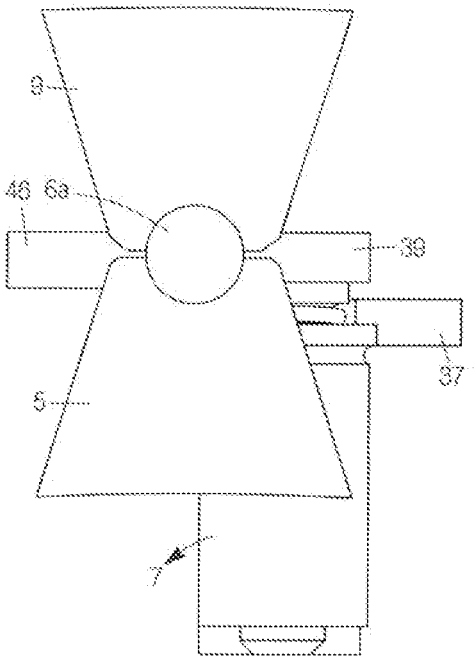
FIG. 41 is a front view of FIG. 40.

Specifically, because the support ring 71 of the inner wheel 4 is fixed to the ring gear 26, to which rotative force is transmitted, and is rotated in one direction, and the support ring 71 is fixed to the punching drum 65 so as to be rotated together therewith, the punching unit 11 is rotated together with the inner wheel 4 in the same direction and at the same speed. Furthermore, the punches 13, which are coupled to the guide holes 66 in the punching drum 65 so as to be capable of reciprocating, are also rotated together with the punching drum 65 when the punching drum 65 is rotated, and the cam follower bearing 84 mounted to the punch 13 is engaged with the cam groove 88 in the cylindrical cam 12, which is in a stationary state, so as to be linearly reciprocated along the cam groove 88. When the cam follower bearing 84 reaches the advance cam groove 88*a*, the rod body 80 is moved forwards, as illustrated in FIG. 33, and the front end of the steel wire piece 6 is pressed and punched into the nail head 6*a* by the punching surface 81 using the pressing force of the punch push roller 18, as illustrated in FIG. 41.

When the punching unit 11 is pulled from the front surface of the inner wheel 4, the projecting rods 73 are separated from the plurality of coupling grooves 72, and the punching unit 11 is thus separated from the inner wheel 4.

The embodiment of the present invention further includes a fixing unit configured to fix the punching unit 11, which is coupled to the inner wheel 4 by means of the coupling unit, to thus prevent the coupling unit from being loosened or separated from the inner wheel 4 during the operation of the system.

The fixing unit includes a block 112, which is fastened and fixed to the front surface of the fixing plate 69 by means of a plurality of bolts 112*a* and 112*b*, threaded pipes 113 and 114, which are rotatably coupled to two sides of the block 112 so as to be moved forwards and rearwards by a predetermined distance and to be freely rotated and which are provided on the inner circumferential surfaces thereof with threads, knobs 115 and 116 respectively formed at the ends of the threaded pipes 113 and 114, a plurality of threaded rods 97 and 98 fixed to the front surface of the shaft pipe 23 fixed to the base wall 2, and through holes 70*a* and 70*b* in the fixing plate 70 in which the threaded rods 97 and 98 are loosely fitted. when the punching unit 11 is coupled to the front surface of the inner wheel 4 by means of coupling unit, the plurality of projecting rods 73 fixed to the rear surface of the support ring 71 are coupled into the plurality of coupling grooves 72 formed in the inner wheel disc 25, and, at the same time, the threaded rods 97 and 98 fixed to the shaft pipe 23 reach the entries of the threaded pipes 113 and 114 through the through holes 70*a* and 70*b* in the fixing plate 70. Here, when the threaded pipes 113 and 114 are rotated in a fastening direction using the knobs 115 and 116, the front and rear fixing plates 69 and 70 are fixed, the cylindrical cam 12 fixed to the fixing plate 69 is also fixed, and the punching drum 65 is rotated together with the inner wheel 4, thereby preventing the punching unit 11 from being loosened or separated during the operation of the system.

The block 112 is securely fixed by means of the plurality of bolts 112*a* and 112*b*, which are inserted through the block 112 and are then engaged with the threaded grooves 69*b* formed in the fixing plate 69. The fixing plate 69 has therein a through hole 69*a* formed in the center thereof.

The punching unit 11 includes the opening unit capable of opening and closing the punching unit 11.

The opening unit includes upper and lower guide pipes 100 fixed to the base wall 2, upper and lower rods 101 respectively coupled to the guide pipes 100, a fixing block 102 fixed to the ends of the rods 101, an arm 106 hingedly coupled to the fixing block 102 via a shaft pin 103, and a plurality of fastening rods 106*a*, which are fixed to the end of the arm 106 and are fastened to the fixing plate 69 disposed at the front surface of the punching unit 11.

The opening unit further includes a knob 105 vertically projecting upwards from the upper surface of the fixing block 102.

Because the guide pipes 100 and the rods 101 are disposed at upper and lower sides, it is possible to prevent the punching unit 11 from drooping even when the punching unit 11 is opened, as illustrated in FIGS. 5 and 6. Furthermore, because a stopper 101*a* is connected to the rear end of each of the upper and lower rods 101 fitted in the guide pipes 100, even when the punching unit 11 is excessively pulled forwards using the knob 105 in order to open the punching unit 11, the stopper 101*a* catches on the guide pipe 100, thereby preventing separation of the punching unit 11 and a safety accident.

When it is intended to open the punching unit 11, the threaded pipes 113 and 114 are rotated in a loosening direction using the knobs 115 and 116 of the fixing unit, and the threaded pipes 113 and 114 are separated from the threaded rods 97 and 98, thereby releasing the fixed state of the punching unit 11. When the punching unit 11 is pulled or moved forwards using the knob 105 in this state, the upper and lower guide pipes 100 are moved forwards, and the punching unit 11, which is supported by the arm 106, is also moved, whereby the threaded rods 97 and 98 fitted in the through holes 70*a* and 70*b* are separated from the fixing plate 70. When the punching unit 11 is rotated about the shaft pin 103 in this state, the rear portion of the punching unit 11 and the inner wheel 4 are exposed, as illustrated in FIGS. 5 and 6, thereby conferring an effect of allowing easy replacement and repair of components such as the inner and outer wheel dies 5 and 9 and the clamp 7, which are disposed in the system.

By performing the opening procedure in the reverse order, the punching unit 11 is coupled and fixed to the inner wheel 4.

The punch push roller 18 is rotatably mounted on the outer circumferential surface of a shaft rod 110 mounted to the block 112 so as to be freely rotatable, and the end of the shaft rod 110 is coupled into a depressed groove 202 in a fixing member 201 fixed to the front surface of the base wall 2 and is then fixed by a cover 117 via a bolt 203.

The punch push roller 18 is positioned on the front surface of the punching portion 15 so as to press the body 77 of the punch 13, which is linearly reciprocated. Accordingly, the punch push roller 18 presses the punch 13, which is moved in the forward direction of the punching portion by the punching drum 65, and thus presses and punches the front end of the steel wire piece 6, thereby forming a nail head 6*a* having a constant size and thickness and good quality.

The embodiment of the present invention further includes a fine adjustment unit configured to adjust the pressing force of the punch 13 by moving the rotational center of the punch push roller 18 using an eccentric cam.

The fine adjustment unit includes an eccentric cam 111 formed at the shaft rod 110, a bearing 18*a* coupled to the outer circumferential surface of the eccentric cam 111, the punch push roller 18 coupled to the outer circumferential surface of the bearing 18*a*, and an adjuster 19 configured to finely adjust the rotational center (or the eccentricity) of the punch push roller 18 by rotating the eccentric cam 111.

Figure 36:
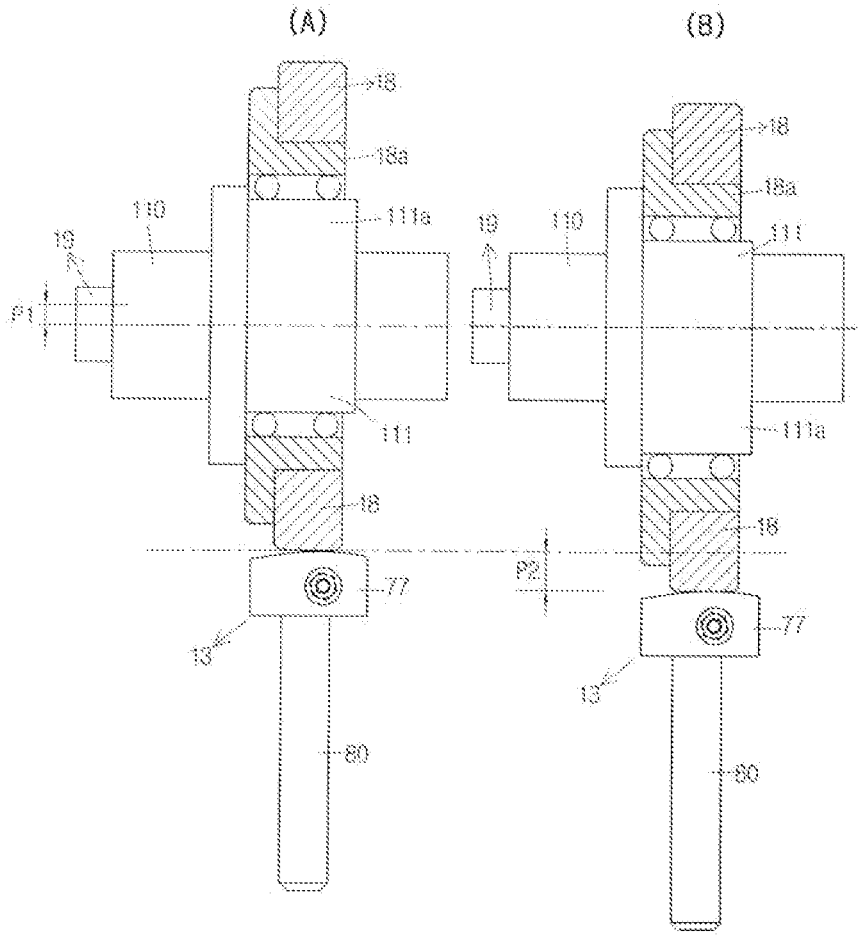
FIG. 36 is a cross-sectional view illustrating fine adjustment by the punch push roller of the nail-making system according to the embodiment of the present invention, (A) illustrating the state in which an adjustment cam is adjusted so as to be moved rearwards and (B) illustrating the state in which the adjustment cam is adjusted so as to be moved forwards.

(A) of FIG. 36 illustrates the state in which an eccentric portion 111*a* is moved back away from the punching portion 15 by a first distance P1 in order to reduce the pressing force, applied to the body 77 of the punch 13 by the punch push roller 18, by rotating the eccentric cam 111 using the adjuster 19. (B) of FIG. 36 illustrates the state in which an eccentric portion 111*a* is moved forwards to the punching portion 15 by a second distance P2 in order to increase the pressing force, applied to the body 77 of the punch 13 by the punch push roller 18, by rotating the eccentric cam 111 using the adjuster 19.

Figure 46:
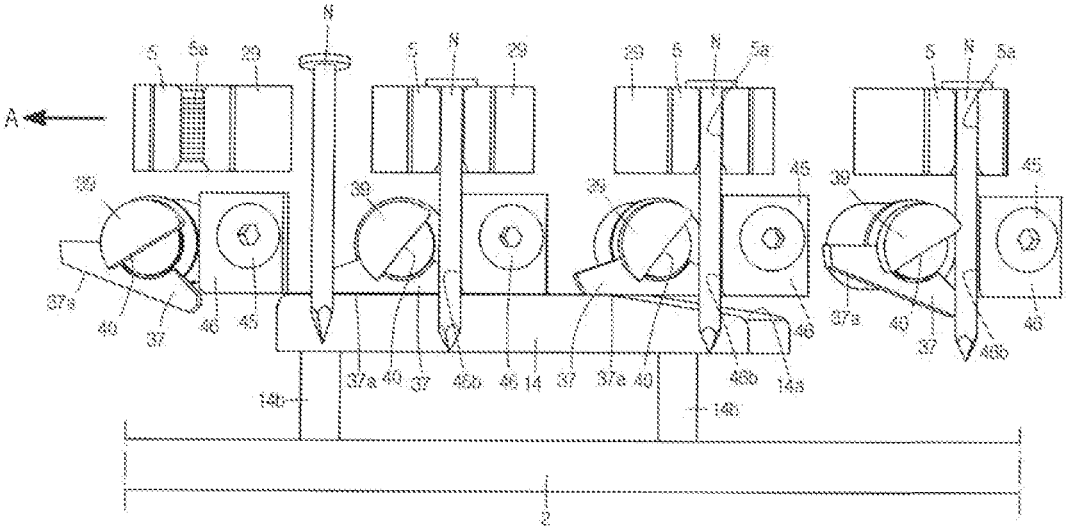
FIG. 46 is a plan view illustrating a procedure in which the clamped nails are sequentially unclamped and discharged by the ejector according to the embodiment of the present invention.

In the embodiment of the present invention, the ejector 14, which is provided in the discharge space 21 or a discharge portion 16, is fixed to the front surface of the base wall 2 using a fixing member 14*b* such as a fixing rod or a bracket, and has a sloped surface 14*a*, which is formed at the side thereof opposite the side thereof in the direction in which the inner wheel 4 is rotated (the "A" direction), as illustrated in FIG. 46.

Figure 47:
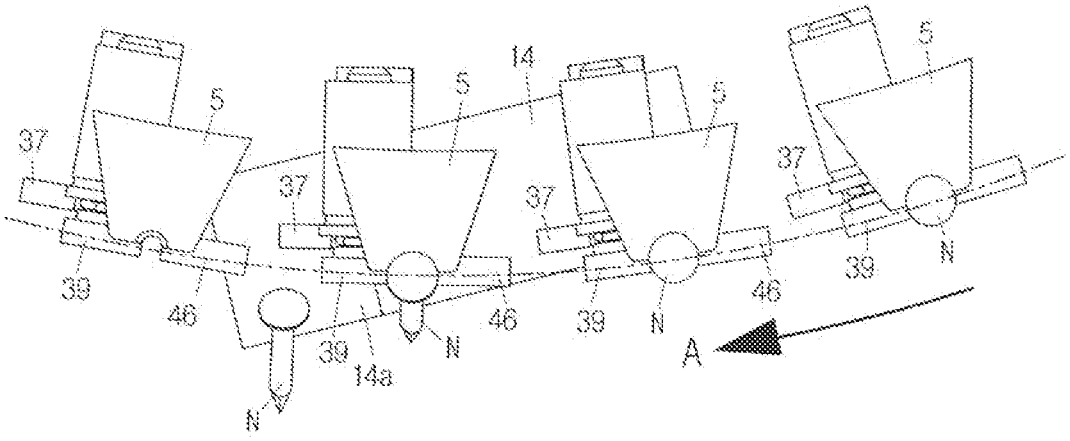
FIG. 47 is a front view illustrating the procedure in which the clamped nails are sequentially unclamped and discharged by the ejector according to the embodiment of the present invention.

As illustrated in FIGS. 46 and 47, when the actuating lever 37 of the clamp 7, which is moved in the "A" direction together with the inner wheel 4 in the state of clamping a nail N, is moved along the sloped surface 14*a*, the actuating lever 37 is rotated in a counterclockwise direction, and the elastic support portion 39 is also rotated in the counterclockwise direction, thereby unclamping the nail N. The nail N, from which the gripping force applied thereto is released, falls along the sloped chute 22 and is discharged to the outside by its own weight. When the actuating lever 37 escapes from the ejector 14, the actuating lever 37 is transferred to the steel wire introduction portion 10, and is maintained at an angle (θ2) of 100 to 140 degrees with respect to the direction in which the steel wire 6 is introduced (the "B" direction) by the elastic force of the torsion spring 38 until a fresh steel wire piece 6 is introduced.

Figure 38:
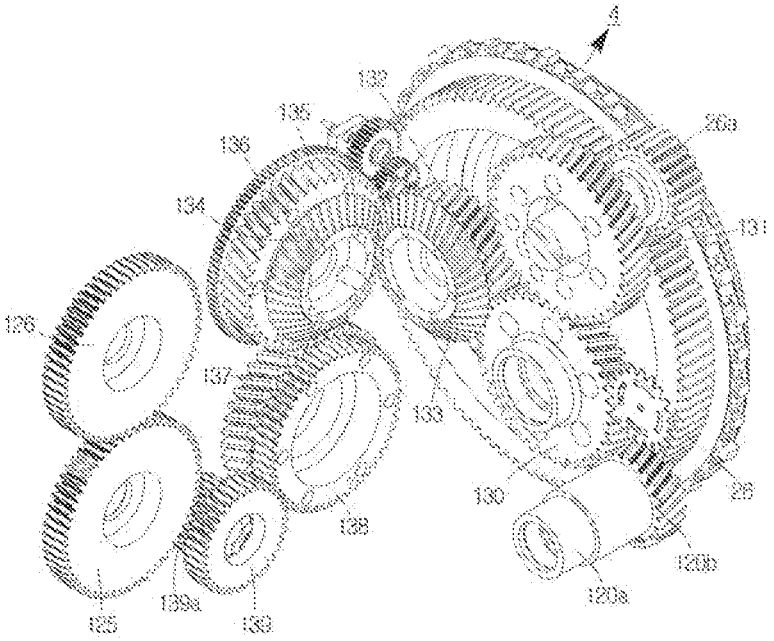
FIG. 38 is a view illustrating a power transmission unit composed of a plurality of gears according to the embodiment of the present invention.
Figure 39:
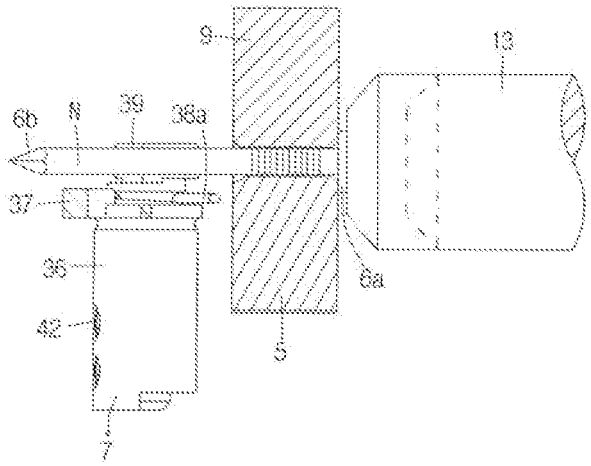
FIG. 39 is a plan cross-sectional view illustrating the state in which the front end of a steel wire piece is punched so as to form a nail head thereon by the punch, which moves forwards while being gripped by the inner and outer wheel dies according to the embodiment of the present invention.
Figure 40:
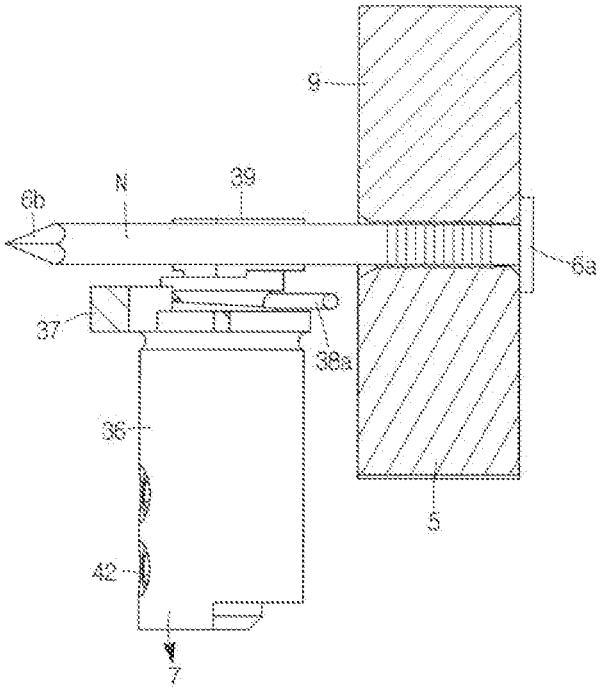
FIG. 40 is a plan cross-sectional view illustrating the state in which the punch shown in FIG. 39 is moved backwards.

FIG. 38 illustrates a power transmission unit. In the power transmission unit, the rotative force of the motor 3 is transmitted to a belt 121, a pulley 120, a tension pulley 121*a*, a first gear 120*b* fixed to a pulley shaft 120*a*, a second gear 130, a third gear 131, a small-sized gear 26*a*, and the ring gear 26 in that order, thereby rotating the inner wheel 4 in one direction. Furthermore, the power is transmitted to a fourth gear 132, a fifth gear 133, a sixth gear 134, a seventh gear 135, and an eighth gear 137, thereby rotating the upper and lower cutting roller 144 and 145 to cut the steel wire 6. Furthermore, the power is transmitted to the high-speed feeding portion 146 via a ninth gear 136, thereby introducing the steel wire piece 6 having a predetermined length into the inner wheel 4 at high speed so as to be clamped. Furthermore, the power is transmitted to a tenth gear 138, an eleventh gear 139, and a twelfth gear, both of which constitute a change gear, a thirteenth gear 125, a fourteenth gear 126 and the upper and lower transfer rollers 142 and 143, thereby controlling the transfer speed of the steel wire 6 to thereby set the length of the nail N.

Figure 42:
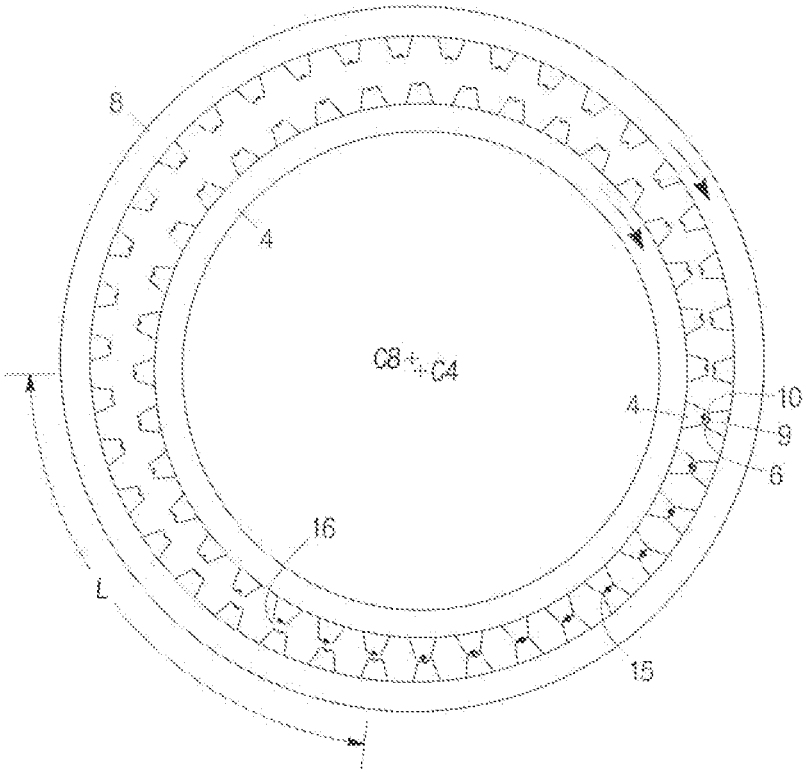
FIG. 42 is a conceptual diagram illustrating the state in the outer wheel is passively rotated by the steel wire piece clamped by the inner wheel according to the embodiment of the present invention.
Figure 43:
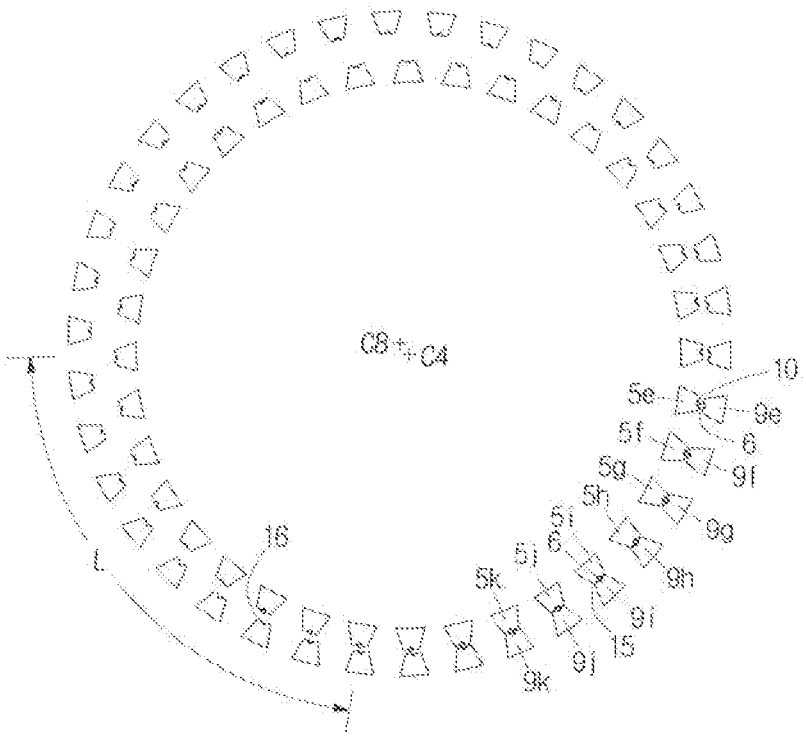
FIG. 43 is a conceptual diagram illustrating the state in which the steel wire piece, which is transferred to the punching portion together with the inner wheel die, is gripped by the outer wheel die according to the embodiment of the present invention.
Figure 44:
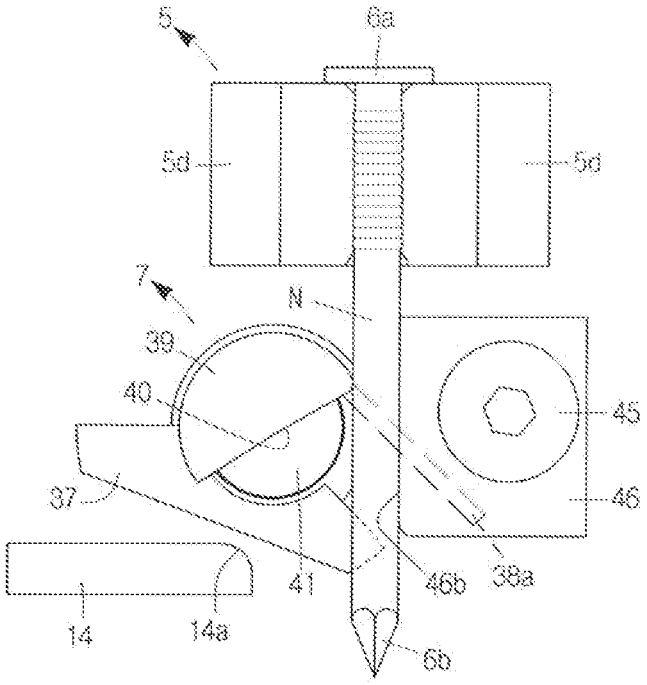
FIG. 44 is a plan view illustrating the state before the clamped steel wire piece is unclamped by an ejector according to the embodiment of the present invention.

FIGS. 42 and 43 are conceptual diagrams illustrating the state in which the outer wheel 8 and the outer wheel dies 9 are passively rotated by rotation of the steel wire pieces 6 according to an embodiment of the present invention. The inner wheel 4, which has a smaller outside diameter, rotates in a clockwise direction (the direction of the arrow) about the axis C4, and the outer wheel 8, which has an inside diameter greater than the outside diameter of the inner wheel 4, is passively rotated about the axis C8 by the steel wire pieces 6, which are moved together with the inner wheel 4. When the outer wheel 8 is moved closest to the gripping groove 5*a* in the inner wheel die 5 at the punching portion 15, the inner wheel die 5 and the outer wheel die 9 forcibly grip the outer circumferential surface of the front end of the transferred steel wire piece 6, whereby the steel wire piece 6 is not moved back when the nail head 6*a* is formed at the steel wire piece through punching.

When the steel wire piece 6 is introduced into the steel wire introduction portion 10, which is defined between the gripping groove 5*a* in the inner wheel die 5*e* and the gripping groove 9*a* in the outer wheel die 9*e*, which are slightly spaced apart from each other due to the difference between the outside diameter of the inner wheel 4 and the inner diameter of the outer wheel 8, the front end of the steel wire piece 6 pushes the flat surface 40 to thereby rotate the elastic body 41 in a counterclockwise direction, as illustrated in FIG. 19. When the steel wire piece 6 is introduced more deeply therein, the steel wire piece 6 is moved over the gripping groove 5*a* in the inner wheel die 5 and is stopped by means of the stopper 17, as illustrated in FIG. 20. At this time, the steel wire piece 6 is elastically supported and clamped at both side surfaces thereof by the lateral side surface 46*b* of the support plate 46 and the elastic support portion 39, which is elastically biased in a clockwise direction, and the clamped wire steel piece 6 is continuously moved together with the inner wheel 4.

Because the distance between the end of the inner wheel die 5*e* and the end of the outer wheel die 9*e* is set to be less than the diameter of the steel wire piece 6 by means of the outer wheel adjustment unit or the outer wheel adjuster 49, the outer end of the gripping groove 9*a* in the outer wheel die 9*e* is caught by the outer surface of the steel wire piece 6. Consequently, the outer wheel 8 is passively rotated in a clockwise direction together with the inner wheel 4 by the steel wire piece 6, and the steel wire piece 6 is continuously moved in a clockwise direction, that is, toward the punching portion 15, in the state of being caught between the gripping groove 5*a* in the inner wheel die 5*e* and the gripping groove 9*a* in the outer wheel die 9*e*.

When the steel wire piece 6 is moved to the location between the inner wheel die 5*f* and the outer wheel die 9*f*, the steel wire piece 6 is more securely caught between the gripping groove 5*a* in the inner wheel die 5*f* and the gripping groove 9*a* in the outer wheel die 9*f*. When the steel wire piece 6, which is continuously moved together with the inner wheel 4, reaches the location between the inner wheel die 5*g* and the outer wheel die 9*g*, both side surfaces of the steel wire piece 6 are gradually gripped between the gripping groove 5*a* in the inner wheel die 5*g* and the gripping groove 9*a* in the outer wheel die 9*g*, and the outer wheel 8 is passively rotated in a counterclockwise direction.

When the steel wire piece 6 is further moved to the location between the inner wheel die 5*h* and the outer wheel die 9*h*, the steel wire piece 6 is further gripped between the gripping groove 5*a* in the inner wheel die 5*h* and the gripping groove 9*a* in the outer wheel die 9*h*. When the steel wire piece 6, which is continuously moved together with the inner wheel 4, reaches the location between the inner wheel die 5*i* and the outer wheel die 9*i*, which together constitute the punching portion 15, the front end of the steel wire piece 6 is forcibly gripped between the gripping groove 5*a* in the inner wheel die 5*i* and the gripping groove 9*a* in the outer wheel die 9*i*. In this state, the associated punch 13 is moved forwards by the cam follower bearing 84 disposed in the advance cam groove 88*a* in the cylindrical cam 12, and the punch push roller 18, which is positioned in front of the punching portion 15, presses the body 77 of the punch 13. As a result, the rod body 80 is moved to the steel wire piece 6, and the punching surface 81 thus presses and punches the front end of the steel wire piece 6 to form the nail head 6*a* having a normal shape.

Because the distance between the gripping groove 5*a* and the gripping groove 9*a* gradually increases as the nail N having the formed nail head 6*a* is moved close to the location between the inner wheel die 5*j* and the outer wheel die 9*j* by the continuous rotation of the inner wheel 4, the gripping force is decreased, and the next steel wire piece 6 is moved to the punching portion 15 and is punched thereat.

Because the distance between the gripping groove 5*a* and the gripping groove 9*a* further increases as the nail N having the formed nail head 6*a* reaches the location between the inner wheel die 5*k* and the outer wheel die 9*k* by the continuous rotation of the inner wheel 4, the gripping force is greatly lowered, or is almost eliminated. Here, the state in which the nail N is clamped by the clamp 7 of the inner wheel 4 is continuously maintained, and the gripping groove 9*a* in the outer wheel die 9 is moved away from the nail N.

When the clamped nail N is moved to the discharge portion 16 together with the inner wheel 4, the ejector 14 pushes the actuating lever 37 of the clamp 7 to thus rotate the elastic body 41 in a counterclockwise direction, as illustrated in FIG. 45. Consequently, because the elastic support portion 39, which is engaged with the nail N, is moved away from the nail N by a predetermined distance La, the nail N is unclamped. Here, although the nail N is maintained in interference engagement with the gripping groove 5*a* in the inner wheel die 5 due to the strong gripping force at the punching portion 15, the nail N is released from the gripping groove 5*a* and is unclamped by the pushing action of the ejector 14. The unclamped nail N is discharged to the outside along the sloped chute 22 while freely falling.

The zone L in which the ejector 14 is mountable preferably ranges from the discharge portion 16 to the nine o'clock point. Since the ejector 14 is provided with the sloped surface 14*a*, the nail N is easily unclamped.

According to the present invention, because the outer wheel 8, which has a larger inside diameter and is passively rotated, is eccentrically disposed in the inner wheel 4, which has a smaller outside diameter and is rotated by the power transmission unit, such that the same are closest to each other at the punching portion 15, it is possible to grip the steel wire piece 6 while the nail head 6*a* is shaped. The transfer of the steel wire piece 6 is fulfilled by the inner wheel 4, which is rotated at high speed, and the gripping of the steel wire piece 6 during transfer of the steel wire piece 6 is fulfilled by cooperation of the inner wheel die with the outer wheel die. Furthermore, the shaping of the nail head 6*a* of the steel wire piece 6 during transfer of the steel wire piece 6 is fulfilled by the plurality of punches, which are rotated together with the inner wheel 4 and are linearly reciprocated, and the discharge of the nail N having the formed nail head 6*a* is fulfilled by the ejector 14 disposed in the discharge space between the inner wheel 4 and the outer wheel 8. Accordingly, the present invention provides a high-speed and high-quality nail-making system capable of greatly improving productivity and of forming a nail head 6*a* having a normal shape through accurate and reliable punching compared to a conventional nail-making system.

In other words, in the high-speed and high-quality nail-making system according to the present invention, the transfer of the steel wire piece 6, which will be formed into a nail, is fulfilled by the inner wheel 4, which is rotated at high speed, and the gripping of the steel wire piece 6 for performing punching is fulfilled by cooperation of the inner and outer wheel dies 5 and 9, which are positioned closest to each other at the punching portion 15. Furthermore, the shaping of the nail head 6*a* is fulfilled by the punch push roller 18 and the punch 13, which is transferred to the punching portion 15, among the plurality of punches 13, which are rotated together with the inner wheel 4 and are linearly reciprocated by the cylindrical cam 12, and the discharge of the nail N is fulfilled by the ejector 14, which is provided in the discharge space 21 between the inner wheel 4 and the outer wheel 8. Accordingly, there are effects of greatly improving productivity and of providing excellent merchantability of the nail because a nail head 6*a* having a normal shape is formed through individual linear punching.

According to the present invention, since the punch 13, which is transferred to the punching portion 15 together with the inner wheel 4, is pressed so as to perform a punching action by the punch push roller 18, there is an effect of forming a nail head 6*a* having a constant thickness and size and excellent quality.

According to the present invention, since it is possible to adjust the clamping length or the introduction depth of the steel wire piece 6 using the adjustment cam 20 mounted to the cylindrical cam 12, there is an effect of making it possible to easily adjust the size and thickness of the nail head 6*a*.

According to the present invention, the productivity and quality of the nails N are greatly improved by the hybrid-type construction, which is optimized for high-speed production of the nails N, and the clamping of the steel wire piece 6, shaping of the nail head 6*a*, and unclamping and discharge of the nail N having the formed nail head 6*a* are efficiently fulfilled. Furthermore, since the nail head 6*a* having a normal shape is rapidly formed by the punch push roller 18 and the punch 13, which is rotated together with the inner wheel 4 and is linearly reciprocated, there is an effect of improving yield and almost completely eliminating defect.

According to the present invention, there is an effect of making it possible to easily adjust the length of the nail N by exchanging the changer gear.

According to the present invention, since the punching unit 11, which is mounted on the front surface of the inner wheel 4, is configured so as to be openable, there is an effect of making it possible to easily replace and repair components, such as the inner and outer wheel dies 5 and 9 and the clamp 7, which are provided in the system.

According to the present invention, since it is possible to replace the inner and outer wheel dies 5 and 9 and the punch 13, there is an effect of making it possible to accurately form various elements, such as a nail equipped with an offset head, a D-shaped nail, and a roofing nail, as well as a nail N having a normal shape.

According to the present invention, since the single motor 3 and the power transmission unit composed of a plurality of gears, which are engaged with each other, are organically connected to each other so as to almost completely avoid malfunctions, there is an effect of reducing total costs including maintenance costs.

According to the present invention, since the punch push roller 18 individually pushes the punch 13, which is transferred to the punching portion 15, toward the steel wire piece 6 while being passively rotated, there is an effect of making it possible to remarkably reduce abrasion of the cam groove 88 and the advance cam groove 88*a*.

According to the present invention, it is possible to rapidly form the nail head 6*a* having a normal shape by the punch push roller 18 and the punch 13, which is linearly reciprocated by the cylindrical cam 12 in the state in which the steel wire piece 6, which is transferred to the punching portion 15 together with the inner wheel 4, is securely gripped by the inner and outer wheel dies 5 and 9.

As is apparent from the above description, the high-speed and high-quality nail-making system according to the present invention is constructed as follows. The transfer of the steel wire piece 6, which will be formed into a nail, is fulfilled by the inner wheel 4, which is rotated at high speed, and the gripping of the steel wire piece 6 for performing punching is fulfilled by cooperation of the inner and outer wheel dies 5 and 9, which are positioned closest to each other at the punching portion 15. Furthermore, the shaping of the nail head 6*a* is fulfilled by the punch 13, which is transferred to the punching portion 15, among the plurality of punches 13, which are rotated together with the inner wheel 4 and are linearly reciprocated by the cylindrical cam 12, and the discharge of the nail N is fulfilled by the ejector 14 provided in the discharge space 21 between the inner wheel 4 and the outer wheel 8. Accordingly, the productivity of nails is remarkably improved. In addition, since the punches 13, which are individually rotated so as to correspond to the steel wire pieces 6, which are rotated together with the inner wheel 4, are linearly moved at the punching portion 15 by the cylindrical cam 12 and are pressed or punched by the punch push roller 18, thereby rapidly forming the nail head 6*a* having a normal shape, not only is excellent merchantability obtained, but productivity is also further improved by virtue of the remarkable reduction in the amount of time required to form the nail head 6*a*.

The present invention offers an effect of making it possible to form nails having various nail head shapes or variously sized nail heads, such as a nail equipped with an offset head, a D-shaped nail and a roofing nail, as well as a nail N having a normal shape, by replacing the inner and outer wheel dies 5 and 9 and the punch 13.

The present invention offers an effect of forming a high-quality nail head 6*a* having a constant thickness and size because the punch 13, which is transferred to the punching portion 15 together with the inner wheel 4, is pressed so as to perform a punching action using the punch push roller 18.

The present invention offers an effect of making it possible to easily adjust the size and thickness of the nail head 6*a* because it is possible to adjust the clamped length or introduction depth of the steel wire piece 6 by means of the adjustment cam 20 mounted on the cylindrical cam 12.

The present invention offers an effect of remarkably reducing abrasion of the cam groove 88 and the advance cam groove 88*a* because the punch push roller 18 pushes the punch 13, which is transferred to the punching portion 15, toward the steel wire piece 6 while being passively rotated.

According to the present invention, since the nail-making system is optimized for the production of high-quality nails N at high speed, high-quality nails N are produced at high speed. Furthermore, the clamping of the steel wire piece 6, the formation of the nail head 6*a*, and the unclamping and discharge of the nail N having the formed nail head 6*a* are efficiently fulfilled. In addition, since nail heads 6*a* each having a normal shape are rapidly formed by the punch 13, which is rotated together with the inner wheel 4 and is transferred to the punching portion 15, and by the punch push roller 18, which is configured to press the body of the transferred punch 13, the speed at which the nail heads 6*a* are formed is remarkably improved, the yield is improved, and defects are almost completely eliminated, despite the improvement in speed.

The present invention offers an effect of making it possible to easily adjust the length of the nail N to a desired length.

The present invention offers an effect of making it easy to perform replacement, repair and maintenance of components provided in the system, such as the inner and outer wheel dies 5 and 9 and the clamp 7, because the punching unit 11 mounted on the front surface of the inner wheel 4 is configured so as to be openable.

According to the present invention, since the single motor 3 and the power transmission unit composed of a plurality of gears, which are engaged with each other, are organically connected to each other so as to have almost no malfunction, there is an effect of reducing total costs including maintenance costs.

Although preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A high-speed and high-quality nail-making system comprising:

an inner wheel, which is rotated in one direction by means of a motor and a power transmission unit and which clamps and transfers steel wire pieces, which are sequentially introduced thereinto;

an outer wheel having an inside diameter greater than the outside diameter of the inner wheel, which is passively rotated and which is eccentrically disposed so as to press the steel wire pieces at a punching portion at which the outer wheel is positioned closest to the inner wheel;

inner and outer wheel dies, which are mounted on an outer circumferential surface of the inner wheel and an inner circumferential surface of the outer wheel and which are positioned closest to each other at the punching portion so as to grip the steel wire pieces;

a punching unit, which is rotated together with the inner wheel and which is configured such that punches thereof are linearly reciprocated by means of a cylindrical cam so as to punch front ends of the steel wire pieces gripped between the inner and outer wheel dies to thus form nail heads; and an ejector, which is disposed in a discharge space defined between the inner wheel and the outer wheel and which releases a clamp to unclamp and discharge the finished nail; and wherein the steel wire piece (6) is clamped between a lateral side surface (46*b*) of a support plate (46) fixed to the inner wheel (4) and an elastic portion (39) of each of the clamps (7), which is biased in a clockwise direction.

2. The high-speed and high-quality nail-making system according to claim 1, wherein the inner wheel includes:

a shaft pipe (23) fixed to a front surface of a base wall;

an inner wheel disc (25) rotatably mounted on an outer surface of the shaft pipe (23) via a ring bearing (24);

a ring gear (26) fixed to a rear surface of the inner wheel disc (25);

a plurality of inner wheel dies (5) and a plurality of clamps (7), which are alternately mounted on an outer circumferential surface of the inner wheel disc (25) at regular intervals; and a fixing ring (27) and a fastener (28), configured to fix the ring bearing (24).

3. The high-speed and high-quality nail-making system according to claim 1, wherein the outer wheel includes:

a ring base (50) mounted on the front surface of the base wall;

a ring bearing (55) mounted at a stepped portion (51) of the ring base (50) by means of a fastening element (52) and fixing rings (53 and 54);

an outer wheel disc (57) mounted on a front surface of the ring bearing (55) so as to be freely rotatable by means of a fastening element (56);

a plurality of outer wheel dies (9) fixed to an inner circumferential surface of the outer wheel disc (57) at regular intervals; and a fixing member (58) configured to fix the outer wheel dies (9).

4. The high-speed and high-quality nail-making system according to claim 1, further comprising a stopper configured to prevent excessive forward movement of the steel wire pieces, which are sequentially introduced.

5. The high-speed and high-quality nail-making system according to claim 1, wherein a distance between one of the plurality of inner wheel dies and a corresponding one of the plurality of outer wheel dies ranges from 0.5 mm to 5 mm.

6. The high-speed and high-quality nail-making system according to claim 1, wherein a number of inner wheel dies is the same as a number of clamps, and a number of outer wheel dies is greater than the number of inner wheel dies by one to five.

7. The high-speed and high-quality nail-making system according to claim 1, wherein a steel wire, which is to be cut into the steel wire pieces, is formed into a linear state by means of horizontal correction rollers (140) and vertical correction rollers (141), is controlled in transfer speed by means of upper and lower transfer rollers (142 and 143), rotational speeds of which are controlled by means of a change gear, and is cut into the steel wire pieces each having a predetermined length by means of upper and lower cutting rollers (144 and 145), the steel wire pieces being sequentially introduced into a steel wire introduction portion (10) by means of a high-speed feeding portion (146) and being clamped by the clamps, which are fixed to the outer circumferential surface of the inner wheel (4) at regular intervals.

8. The high-speed and high-quality nail-making system according to claim 7, wherein a rotational speed of the upper and lower transfer rollers (142 and 143) is controlled by varying a gear ratio of the change gear so as to set a cutting length of the steel wire and a length of a nail.

9. The high-speed and high-quality nail-making system according to claim 1, wherein the punching unit includes:

a cylindrical punching drum (65);

a plurality of guide holes (66) formed in a peripheral portion of the punching drum (65) at regular intervals;

punches (13) fitted into the guide holes (66) so as to be capable of reciprocating;

a ring bearing (68) coupled into a cavity (67) in the punching drum (65);

front and rear fixing plates (69 and 70) coupled to an inner circumferential surface of the ring bearing (68);

a support ring (71) fixed to a rear surface of the punching drum (65);

a plurality of projecting rods (73), which are fixed to a rear surface of the support ring (71) and which project rearwards and are coupled into coupling grooves (72) formed in a front surface of the inner wheel (4) so as to transmit rotative force of the inner wheel (4) to the punching drum (65); and a cylindrical cam (12) fixed to the front fixing plate (69), the punches (13) being coupled into a cam groove (88) in the cylindrical cam (12).

10. The high-speed and high-quality nail-making system according to claim 9, wherein the punch (13) includes:

a body (77);

a rod body (80) coupled to a lower portion of the body (77);

a slit (79) formed in the body (77) in a longitudinal direction of the body (77);

a punching surface (81) formed at an end of the rod body (80);

a bolt (82) and a nut (83), which are fitted into a fastening hole (78) formed in the body (77) with a slit (79) formed in a center of the body (77) and which press an upper portion of the rod body (80) coupled into a coupling groove formed in the body (77) to fix the body (77) to the rod body (80);

a cam follower bearing (84), which is coupled to an outer surface of a stepped portion of the bolt (82) so as to be freely rotatable and which is coupled into the cam groove (88) in the cylindrical cam (12); and a projecting portion (85) and a recess portion (86), respectively formed at front and rear portions of the body (77).

11. The high-speed and high-quality nail-making system according to claim 1, wherein each of the clamps includes:

a cylindrical pipe (36) having therein a coupling hole (44), which is longitudinally formed and is open upwards;

an actuating lever (37), which projects from an upper surface of the cylindrical pipe (36) in one direction and has a flat surface (37*a*);

an elastic body (41), which is surrounded by a torsion spring (38), has an elastic support portion (39) formed at an upper portion thereof, and has a flat surface (40) formed at one side thereof;

a fixing groove (44*a*) formed in the coupling hole (44) in which a lower end protrusion (38*b*) of the torsion spring (38) is fitted; and an upper end protrusion (38*a*) of the torsion spring (38) projecting upwards from the cylindrical pipe (36).

12. The high-speed and high-quality nail-making system according to claim 11, wherein the flat surface (40) of the elastic body (41), which is elastically supported by the torsion spring (38), is maintained at an angle of about 45 degrees (θ1) relative to a direction in which the steel wire piece (6) is introduced.

13. The high-speed and high-quality nail-making system according to claim 11, wherein the flat surface (37*a*) of the actuating lever (37) is maintained at an angle of 40 to 100 degrees (θ2) relative to a direction in which the steel wire piece (6) is introduced.

14. The high-speed and high-quality nail-making system according to claim 1, further comprising an outer wheel adjustment unit, configured to finely move the outer wheel to thus cause a gripping groove (5*a*) in the inner wheel die (5) to face and to be aligned with a gripping groove (9*a*) in the outer wheel die (9), the outer wheel adjustment unit including:

a shaft pin (48) configured to rotatably support an upper portion of the outer wheel (8); and an outer wheel adjuster (49) configured to support and finely move a lower portion of the outer wheel (8).

15. The high-speed and high-quality nail-making system according to claim 14, wherein the outer wheel adjuster (49) includes:

a shaft portion (49*d*), which has a predetermined outside diameter and is fitted into a through hole (49*a*) in a base wall (2) and a cavity (49*c*) in an eccentric pipe (49*b*);

a flange portion (49*e*) formed at a rear portion of the shaft portion (49*d*);

a plurality of bolts (49*f*) configured to fasten and fix the flange portion (49*e*) to the base wall (2);

a long hole (49*g*), which is formed in the lower portion of the outer wheel (8) and in which an outer circumferential surface of the eccentric pipe (49*b*) is fitted;

a hexagonal protrusion (49*h*), which is formed at a front end of the eccentric pipe (49*b*) and has an outside diameter greater than an inside diameter of the long hole (49*g*);

a plurality of threaded holes (49*i*) formed in a front surface of the shaft portion (49*d*);

a plurality of bolts (49*j*) engaged with the plurality of threaded holes (49*i*); and a washer (49*k*), into which the bolts (49*j*) are inserted and which has an outside diameter greater than an inside diameter of the cavity (49*c*).

16. The high-speed and high-quality nail-making system according to claim 11, wherein the cylindrical cam (12) is configured to have a form of a ring having a predetermined thickness and width, and wherein a cam groove (88), into which cam follower bearings (84) of punches (13) are coupled, is formed along an outer circumferential surface of the cylindrical cam (12), and an advance cam groove (88*a*) is formed in a portion of the cam groove (88) at which the punching portion (15) is positioned so as to move the cam follower bearing (84) toward the punching portion (15).

17. The high-speed and high-quality nail-making system according to claim 16, further comprising an adjustment cam (20), which is mounted on the cylindrical cam (12) so as to adjust a length of a portion of the clamped steel wire piece that is introduced, the adjustment cam (20) including:

a block (91) coupled into a coupling groove (90) formed in the cylindrical cam (12);

a subsidiary cam groove (92) formed in a portion of the block (91);

an adjustment bolt (93) configured to finely adjust the block (91) to thus move the block (91) close to or away from the punching portion (15);

a threaded hole (94) with which the adjustment bolt (93) is threadedly engaged; and a bolt (96) configured to fasten and fix the finely adjusted block (91) into a threaded hole (95) in the subsidiary cam groove (92).

18. The high-speed and high-quality nail-making system according to claim 1, wherein the punching unit includes an opening unit capable of pulling the punching unit to open the inner wheel, and wherein the opening unit includes:

upper and lower guide pipes (100) fixed to the base wall (2);

upper and lower rods (101), which are coupled to the upper and lower guide pipes (100) and each of which has a long length;

a fixing block (102) fixed to front ends of the upper and lower rods (101);

an arm (106) rotatably coupled to the fixing block (102) via a shaft pin (103); and a plurality of fastening rods (105), which are fixed to an end of the arm (106) and are fastened and fixed to a front fixing plate (69) of the punching unit (11).

19. The high-speed and high-quality nail-making system according to claim 1, further comprising:

a punch push roller (18), which is provided at a portion of the punching unit so as to press a punch (13), which is transferred to the punching portion (15) by rotation of the punching drum (65), to thus adjust punching pressure; and a fine adjustment unit configured to move a rotational center of the punch push roller (18) to thus adjust a pressing force of the punch (13).

* * * * *